US009909318B2

(12) United States Patent
Nelson, Jr.

(10) Patent No.: US 9,909,318 B2
(45) Date of Patent: Mar. 6, 2018

(54) ROOF CURB SYSTEM AND METHOD OF INSTALLING

(71) Applicant: EZY-CURB, LLC, Kenner, LA (US)

(72) Inventor: G. Paul Nelson, Jr., Kenner, LA (US)

(73) Assignee: EZY-CURB, LLC, Kenner, LA (US)

( * ) Notice: Subject to any disclaimer, the term of this patent is extended or adjusted under 35 U.S.C. 154(b) by 0 days.

(21) Appl. No.: 15/216,511

(22) Filed: Jul. 21, 2016

(65) Prior Publication Data

US 2017/0022712 A1 Jan. 26, 2017

Related U.S. Application Data

(60) Provisional application No. 62/324,239, filed on Apr. 18, 2016, provisional application No. 62/277,922, (Continued)

(51) Int. Cl.
*E04D 13/03* (2006.01)
*E04B 1/38* (2006.01)
*E04D 13/04* (2006.01)

(52) U.S. Cl.
CPC ..... *E04D 13/032* (2013.01); *E04B 1/38* (2013.01); *E04D 13/0315* (2013.01); *E04D 13/0481* (2013.01)

(58) Field of Classification Search
CPC ..... E04D 13/032; E04D 13/0315; E04D 13/0481; E04D 13/0305; E04D 13/03; E04D 11/02; E04D 3/352; E04D 3/351; E04D 3/30; E04D 3/363; E04D 13/04; E04D 2013/0486; E04D 3/40; E04B 1/38; E04B 7/18; E04B 7/166; F24F 7/02; F24F 13/1406
See application file for complete search history.

(56) References Cited

U.S. PATENT DOCUMENTS 4,559,753 A * 12/1985 Brueske ..... E04D 13/031 52/200
4,649,680 A 3/1987 Weisner et al.
(Continued)

OTHER PUBLICATIONS

PCT Notification of Transmittal of the International Search Report and the Written Opinion of the International Searching Authority, dated Nov. 24, 2016.

*Primary Examiner* — Beth A Stephan
(74) *Attorney, Agent, or Firm* — Garvey, Smith & Nehrbass, Patent Attorneys, L.L.C.; Seth M. Nehrbass; Mackenzie D. Rodriguez

(57) ABSTRACT

The present invention is a curb assembly system for modifying a metal building. The apparatus comprises a plurality of mounting brackets, at least two caps, at least two side rails, at least two end panels, and a plurality of screws. The mounting brackets are placed on support structure of the building, one of the at least two end panels is placed at the low point of the building, one of the at least two side rails is placed on the edge of an existing building panel, the at least two caps are placed a determined distance from each other, another of the at least two side rails is placed parallel to the first side rail, and another of the at least two end panels is placed at the high point of the building, such that there is created a "curb" comprised of the side rails and caps which can support an device or feature that is secured thereon.

19 Claims, 31 Drawing Sheets

Related U.S. Application Data filed on Jan. 12, 2016, provisional application No. 62/242,732, filed on Oct. 16, 2015, provisional application No. 62/195,151, filed on Jul. 21, 2015.

(56) References Cited

U.S. PATENT DOCUMENTS 4,860,511 A 8/1989 Weisner et al.
5,027,576 A * 7/1991 Gustavsson ..... E04D 13/1475 52/200
5,323,576 A 6/1994 Gumpert et al.
6,151,838 A * 11/2000 Husein ..... E04D 13/1475 52/200
6,532,877 B1 3/2003 Hepburn et al.
6,729,083 B1 5/2004 Soyko
6,775,951 B2 8/2004 Gumpert et al.
6,966,157 B1 * 11/2005 Sandow ..... E04D 13/0305 52/200
7,043,882 B2 5/2006 Gumpert et al.
7,308,777 B2 12/2007 Sandow
7,712,279 B2 * 5/2010 McClure ..... E04D 13/0315 52/200
7,937,900 B1 * 5/2011 Gaffney ..... E04D 13/0305 52/200
8,438,798 B2 5/2013 McLain et al.
8,438,801 B2 5/2013 Mclain et al.
8,713,864 B1 * 5/2014 Smith, Jr. ..... E04D 3/28 52/200
8,763,324 B2 7/2014 Pendley et al.
9,032,671 B1 * 5/2015 Pendley ..... E04D 13/0481 52/97
9,127,461 B2 * 9/2015 Pendley ..... E04D 3/352
9,151,057 B2 * 10/2015 Mills ..... E04D 13/1475
9,441,377 B2 9/2016 Pendley et al.
9,534,390 B2 * 1/2017 Pendley ..... E04D 13/031
2007/0094984 A1 5/2007 Mcclure
2010/0162643 A1 * 7/2010 Blomberg ..... E04D 3/364 52/200
2014/0260068 A1 * 9/2014 Pendley ..... E04D 13/031 52/710

* cited by examiner

ROOF CURB SYSTEM AND METHOD OF INSTALLING

CROSS-REFERENCE TO RELATED APPLICATIONS

This application claims the benefit of: U.S. Provisional Patent Application Ser. No. 62/195,151, filed 21 Jul. 2015; U.S. Provisional Patent Application Ser. No. 62/242,732, filed 16 Oct. 2015; U.S. Provisional Patent Application Ser. No. 62/277,922, filed 12 Jan. 2016; and U.S. Provisional Patent Application Ser. No. 62/324,239, filed 18 Apr. 2016; all of which are incorporated herein by reference and priority of/to which are hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an in-line roof curb system that is primarily for roof mounted skylights. More particularly, the present invention relates to a unique roof curb system to be installed on metal buildings.

2. General Background of the Invention

There are almost 56 billion square feet (~5202.57 square kilometers) of R-panel roofs being used in the United States with all other type metal roofs making up an estimated 20% of the remaining market of metal roofs. The typical domed skylight and metal curb is used almost exclusively on the smaller share of the metal roof market.

Almost all R-panel roofs utilize the same type of skylight. This type of skylight is not a curb mounted design, but is rather a translucent fiberglass panel that matches the profile of the R-panels and installed among the runs of metal R-panel. These R-panel skylights are typically 12 feet (3.6576 meters) long and 3 feet (91.44 centimeters) wide. Once installed, the R-panel skylight has an exposed surface of approximately 10 feet (3.048 meters)×3 feet (91.44 centimeters) and is fastened in the same manner as the R-panels, which is in a through-fastened nature utilizing self-tapping screws with rubber washers.

Due to the low cost nature of an R-panel roof, domed skylights have not been utilized because of the expense to custom manufacture and install a metal curb to fit on an R-panel roof that doesn't hinder water flow while housing a domed skylight. Even with the other type of metal roofs, which are more costly than R-panel roofs, this drawback of expense for manufacture and installation has limited the opportunity to install large numbers of domed skylights on metal roofs.

The system of the present invention solves this problem by providing an affordable roof curb system for installing domed skylights on R-panel and other metal roof types that does not hinder water flow.

The following US Patents are incorporated herein by reference: U.S. Pat. Nos. 4,559,753; 4,649,680; 4,860,511; 5,323,576; 6,532,877; 6,775,951; 7,043,882; 8,713,864; 8,438,801; 8,763,324; and 8,438,798.

BRIEF SUMMARY OF THE INVENTION

This present invention is a unique roof curb system to be installed on metal buildings. It is anticipated that the largest use of the in-line roof curb system will be on through-fastened R-panel roofs. Other types of metal roofs can also use this roof curb system such as corrugated, standing seam, and other suitable roof types. Additionally, with some slight modifications, the in-line roof curb system of the present invention could also be installed on other types of low-slope roofing such as Modified Bitumen, TPO (thermoplastic polyolefin), PVC (polyvinyl chloride), and/or EPDM (ethylene propylene diene terpolymer).

The in-line roof curb system is primarily for roof mounted skylights, but can be used for virtually any roof top equipment, for example roof-top HVAC units. The roof curb system allows easy installation of one or more skylights onto metal roofs of metal and other buildings. The roof curb system may be installed running with the slope of the roof system, for example.

The skylights that are to be mounted to the in-line roof curb system can be of any size, type or manufacturer, but it is anticipated that most will be of a dome type skylight with single, double or triple lens. It is also anticipated that prismatic domed skylights will make up a significant amount of the domed skylights installed.

The in-line roof curb system, with some small modifications may also be configured to allow for venting of plumbing stacks, furnace flues and interior building ventilation, and may also serve as a parapet wall when installed on the outer perimeter of the building's roof system. In some embodiments the curb system has conduits to allow for wiring or tubing to be incorporated into the structure. The curb system may also be used for installing other features such as HVAC, lighting, sensors, or other devices.

Additionally, the curb system of the present invention may be installed in the walls of the building.

The apparatus of the present invention is an in-line roof curb system, comprising: one or more skylights; two side rails configured to receive the skylights, wherein the side rails have grooves for mating with the grooves of an existing metal roofing system and raised portions configured to receive the skylights, a first end cap, one or more middle caps (when there is more than one skylight), and a second end cap; a plurality of mounting brackets configured to attach to an existing metal roofing system and to attach to the side rails; a starter panel having grooves for mating with the grooves of the side rails, a coupler configured to receive an end cap, and a cricket to deflect water towards one or more valleys of the grooves of the side rails; a first end cap, configured to mate with an under surface of a skylight, the two side rails, and the coupler of the starter panel; optionally one or more middle caps, wherein the middle caps are placed between the skylights; an eave panel having grooves for mating with the grooves of the side rails, a coupler configured to receive an end cap; and a second end cap, configured to mate with an under surface of a skylight, the two side rails, and the coupler of the eave panel.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
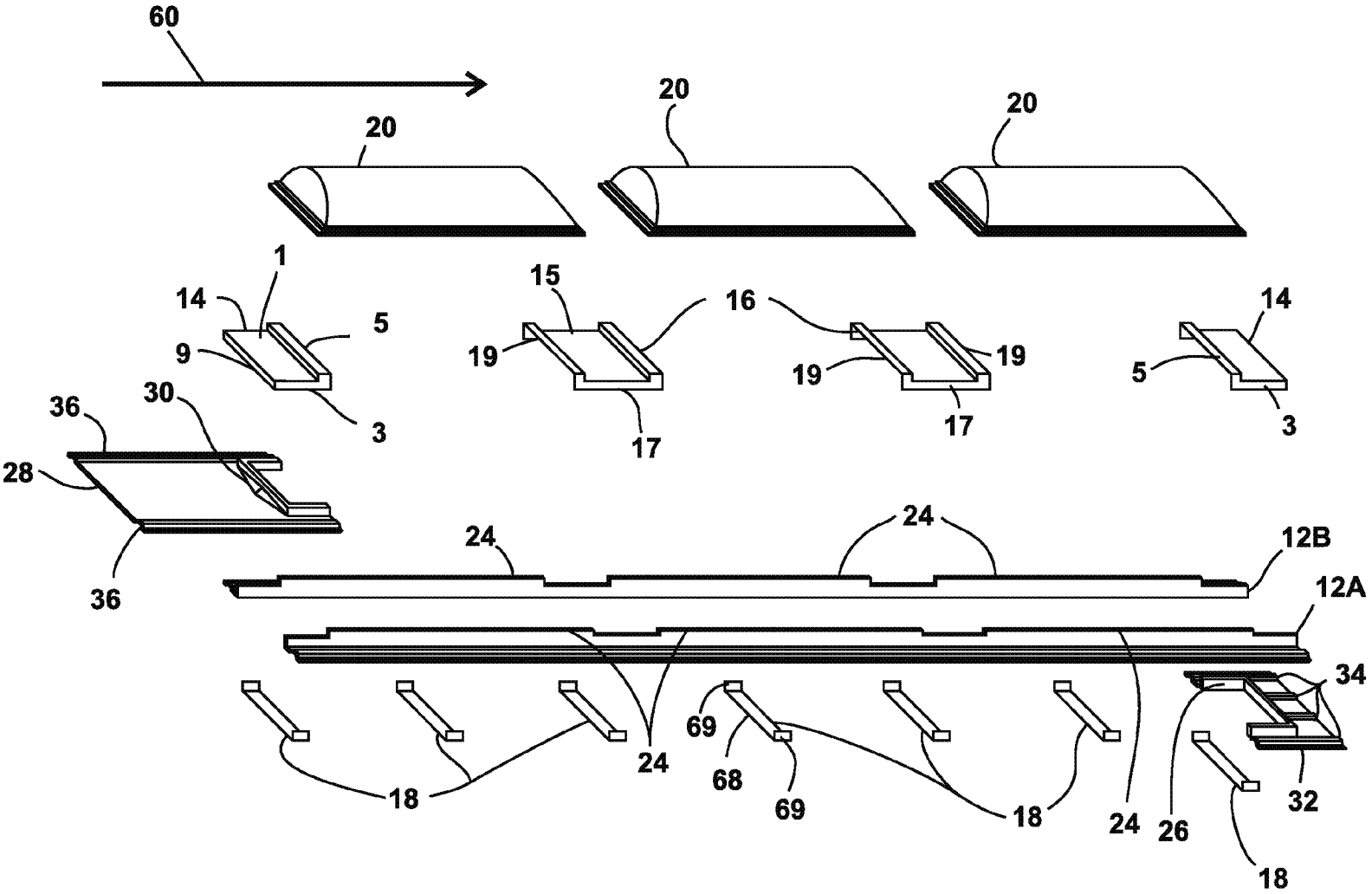
FIG. 1 is an exploded view of a preferred embodiment of the system of the present invention.

The in-line curb system 10 is designed to be economical and easy to install. Domed skylights 20 can easily be retrofitted into existing metal roofs using the unique designed curb system 10 and even easier to add to new metal roof applications. In addition, the curb system of the present invention can be adapted for use with other types of skylights, and other types of equipment to be installed.

In a preferred embodiment, the present design can house one, two, three or more domed skylights 20 in a single in-line curb or multiple curbs can be over-lapped at the ends to provide for extra-long panel runs. The design can accommodate any size skylights while easily integrating into the typical metal panel profile. Multiple in-line curbs may be installed across an entire roof system without adjusting adjoining metal panels. For R-panel applications, it is expected that a typical installation will utilize domed skylights 20 of approximately 2 feet (60.96 centimeters) wide×8 feet (2.4384 meters) long each. The skylights 20 are expected to be spaced from each other by approximately 2 feet (60.96 centimeters), but the distribution pattern can be altered to match a desired internal lighting requirement.

Figures 20, 21, 22, 23:
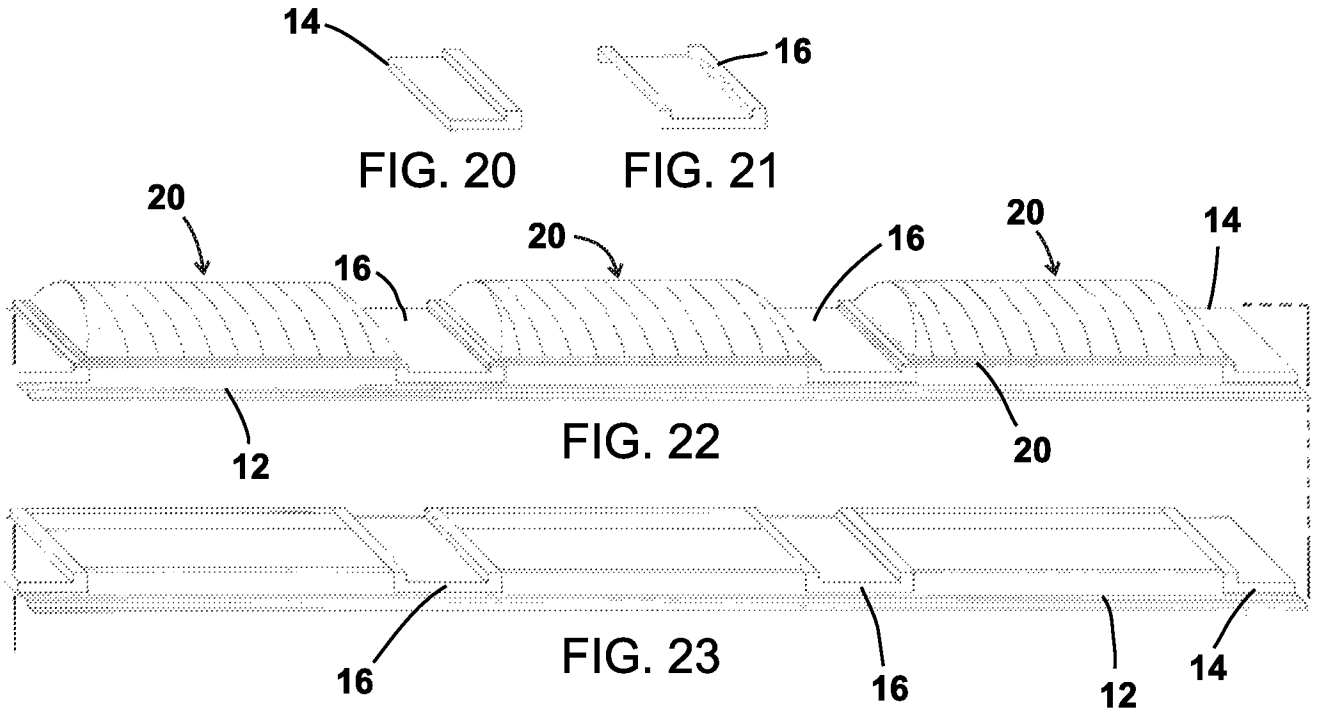
FIG. 20 is a perspective view of the end cap of a preferred embodiment of the curb system of the present invention.
FIG. 21 is a perspective view of the middle cap of a preferred embodiment of the curb system of the present invention.
FIG. 22 is a perspective view of a preferred embodiment of the curb system of the present invention as installed with skylights.
FIG. 23 is a perspective view of a preferred embodiment of the curb system of the present invention without skylights installed.
Figure 24:
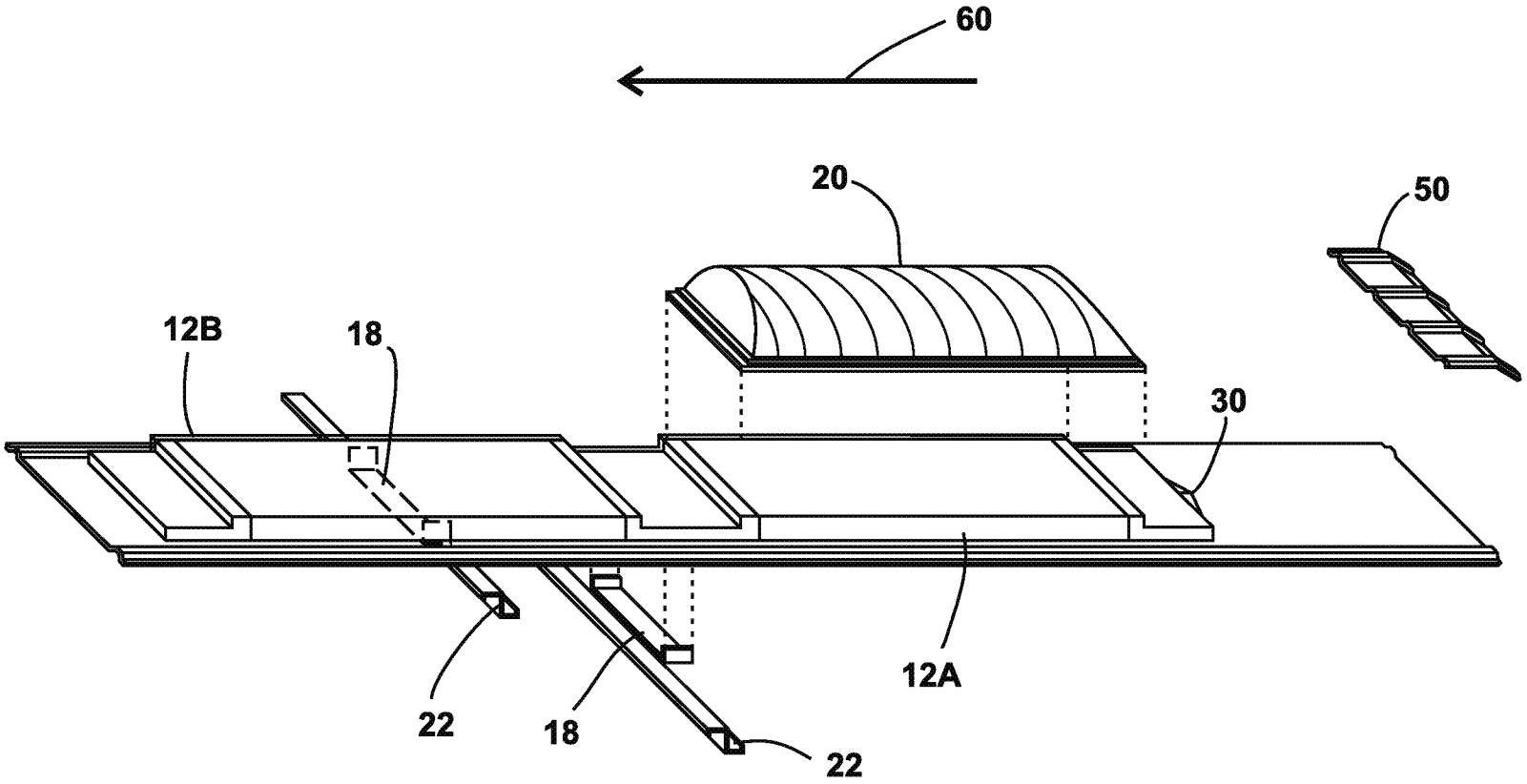
FIG. 24 is an exploded view of a preferred embodiment of the curb system of the present invention used with a skylight.
Figure 25:
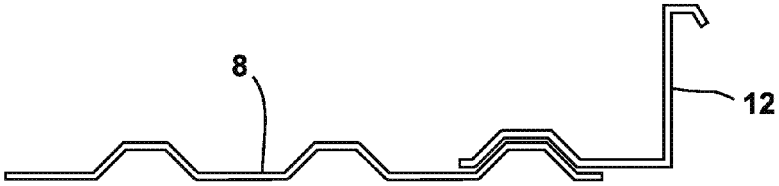
FIGS. 25-29 are profile views of various embodiments of the side rail of the present invention as it mates with a building panel.
Figure 26:
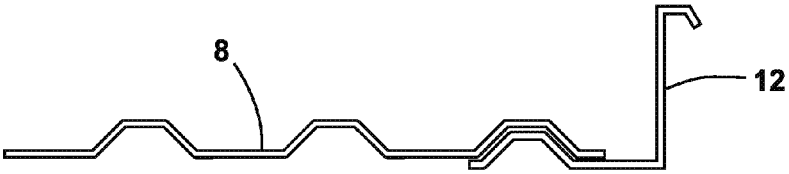
Figure 27:
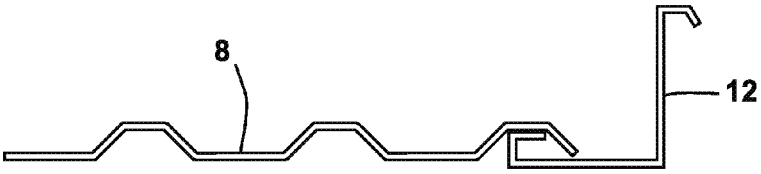
Figure 28:
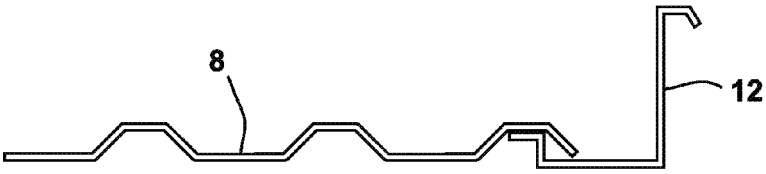
Figure 29:
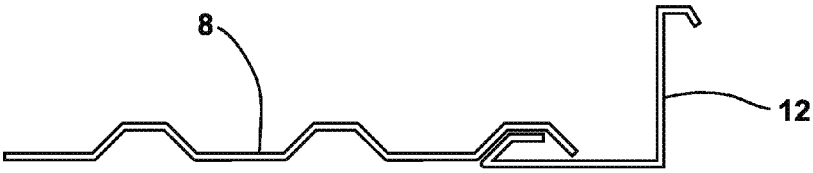
Figure 30:
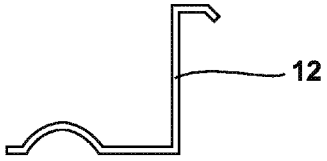
FIGS. 30-31 are additional profile views of different embodiments of the side rail of the present invention.
Figure 31:
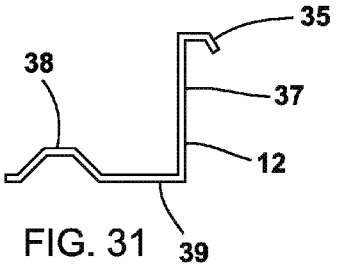

FIG. 1 shows a preferred embodiment of an in-line curb system 10 with three domed skylights 20 un-attached and spaced accordingly. FIG. 23 shows the same in-line curb system 10 without the 3 domed skylights 20 attached. FIG. 22 shows the present embodiment of the in-line curb system with 3 dome skylights 20 in an attached configuration. FIG. 24 shows a preferred embodiment of a single skylight in-line curb system 10 along with mounting brackets 18.

Figure 2:
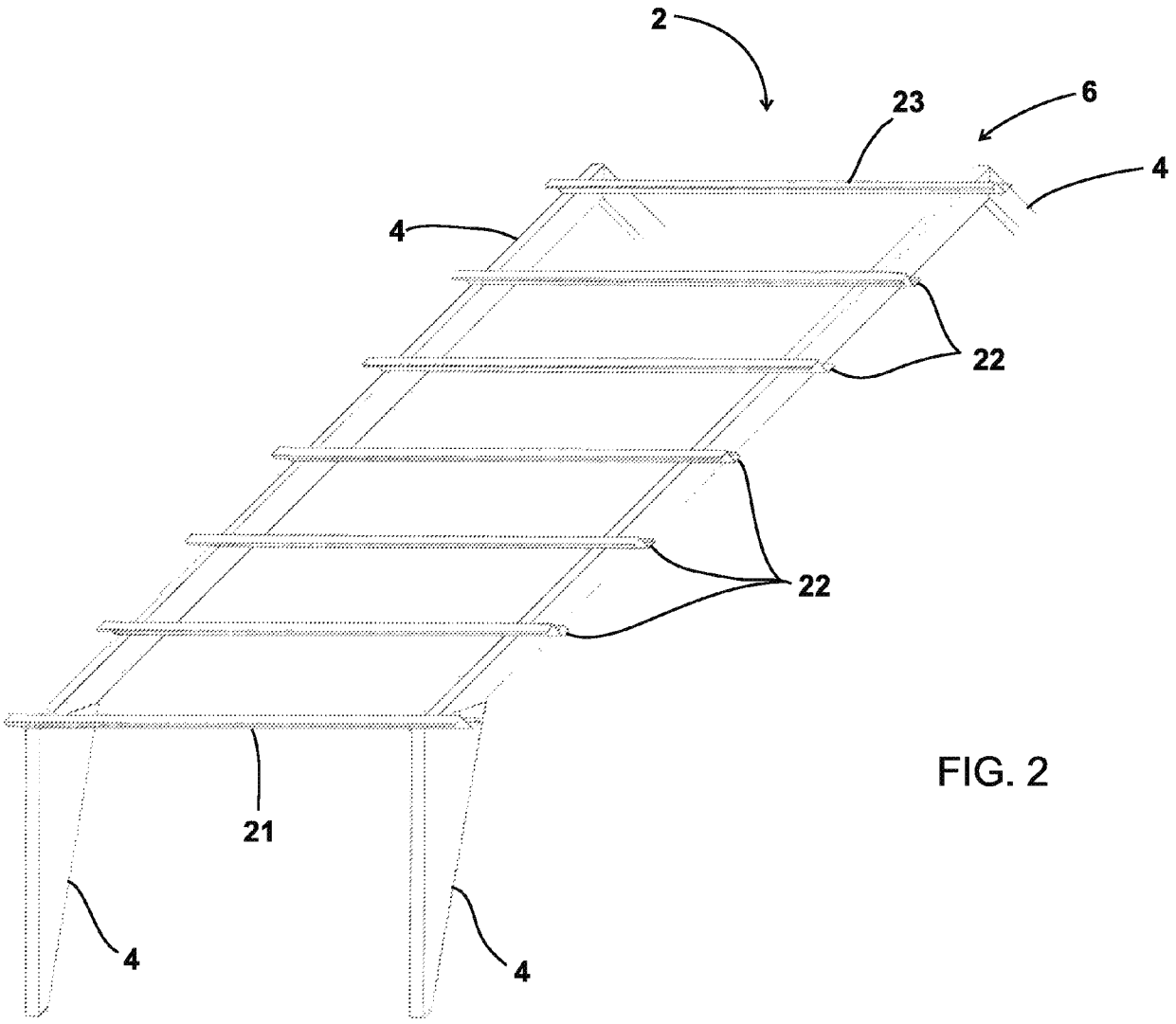
FIG. 2 is a perspective view of one bay of a building prior to installation of roof panels.
Figures 3, 4:
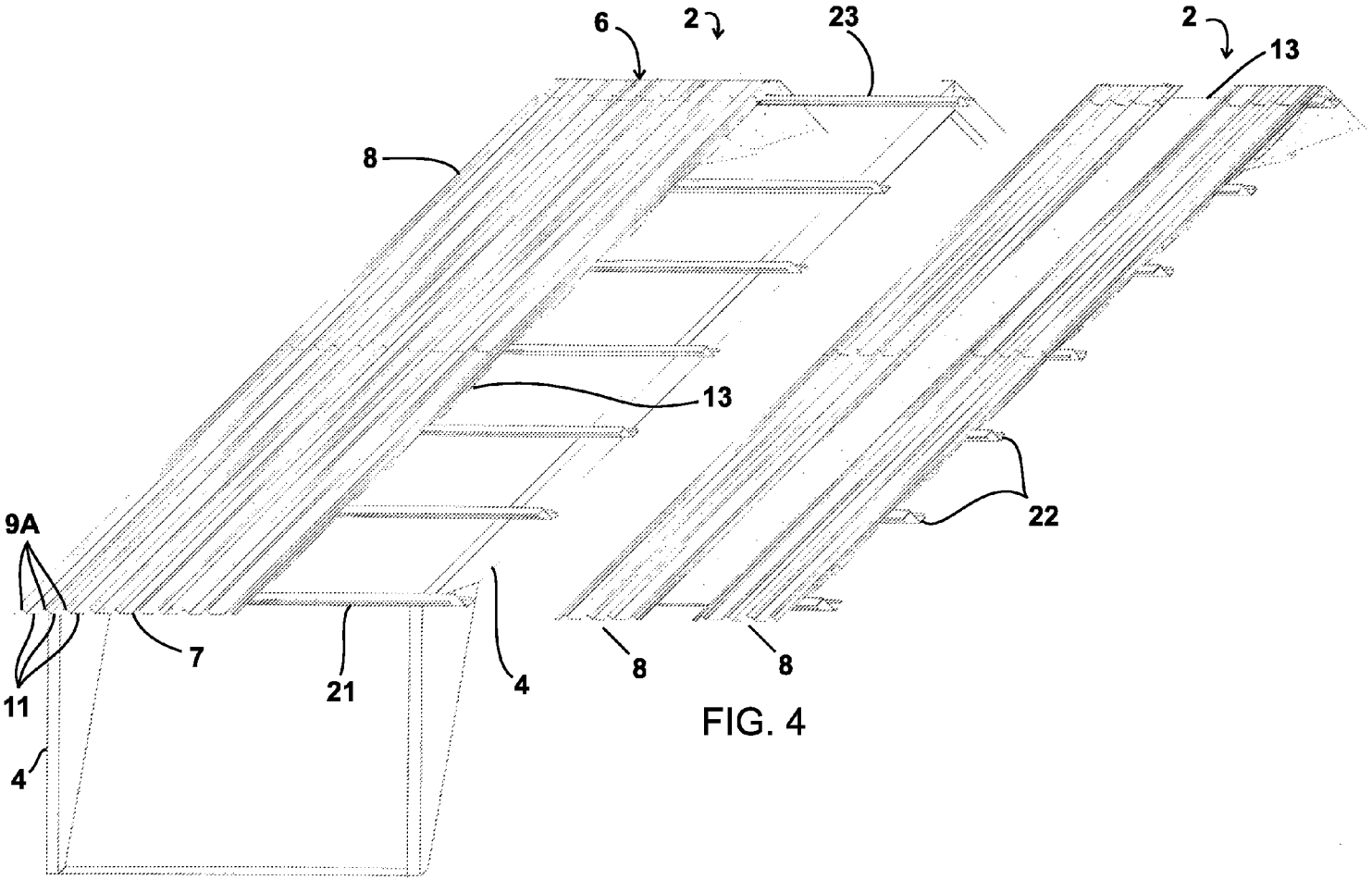
FIG. 3 is a perspective view of the roof bay of FIG. 2 with the roof panels in place prior to skylight installation.
FIG. 4 is a perspective view of the bay of FIGS. 2 and 3 with the center R-panels removed prior to skylight installation.

The following describes an exemplary method to implement the present invention as shown in FIGS. 2-19. This example shows installation of skylights on an R-panel roof It is noted that this method and equipment can be used for installing other types of equipment, on other types of buildings including the walls or roofs of the buildings. For reference, FIG. 2 shows one bay 2 of a metal building with no panels attached. FIG. 3 shows this same bay 2 with insulation 13 and panels 8 on half of the bay 2. Typically metal buildings consist of many of these bays 2 connected together.

Figure 8:
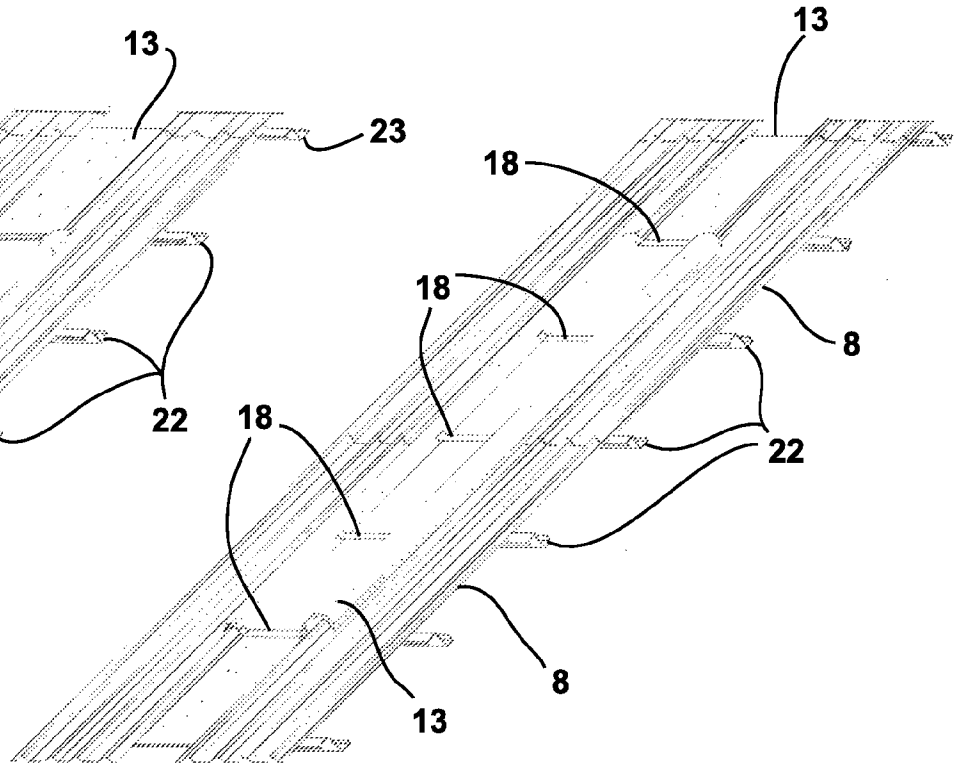
FIG. 8 is a perspective view of the bay of FIGS. 2-4 and 7 showing installation of the mounting brackets of the present invention.
Figure 9:
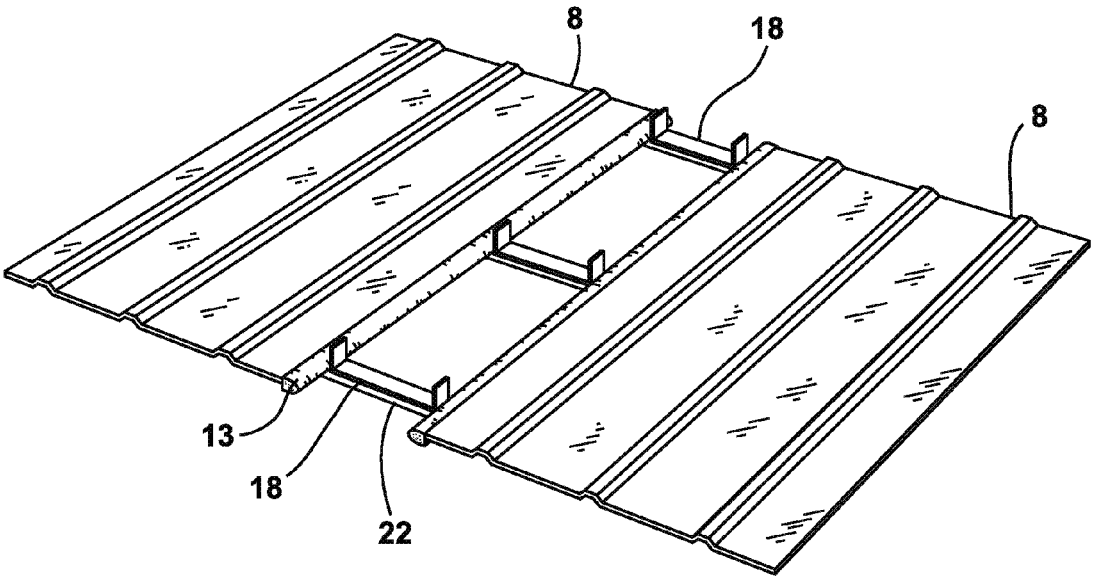
FIG. 9 is a close up view of the installation of mounting brackets shown in FIG. 8.
Figure 11:
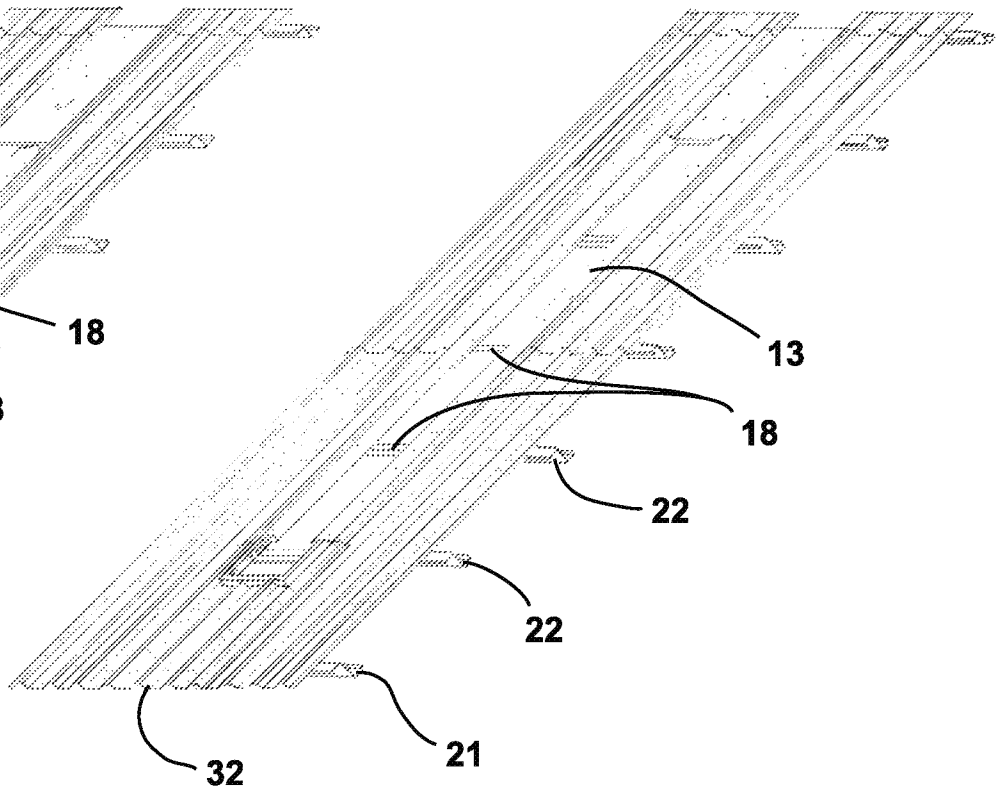
FIG. 11 is a perspective view of the bay of FIGS. 2-4, 7-8, and 10 showing the next step in installation of a preferred embodiment of the system of the present invention wherein the eave panel is installed.
Figure 10:
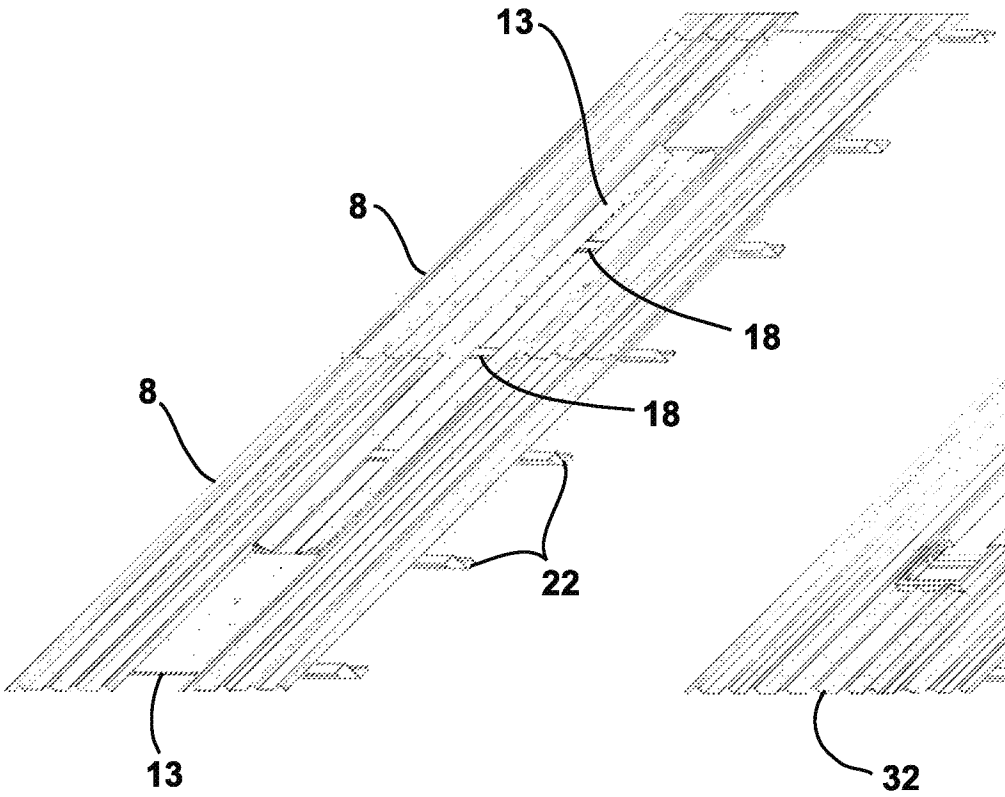
FIG. 10 is a perspective view of the bay of FIGS. 2-4 and 7-8 showing the next step in installation of a preferred embodiment of the system of the present invention wherein the insulation is folded back over the mounting brackets.
Figure 13:
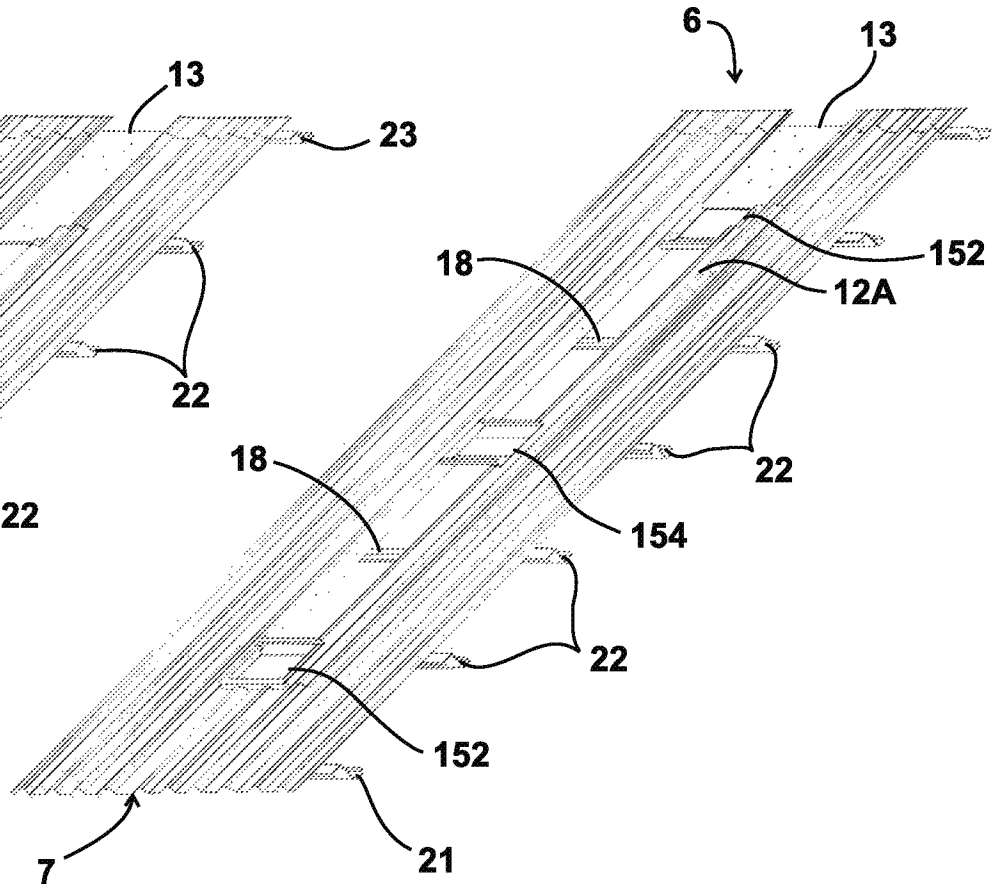
FIG. 13 is a perspective view of the bay of FIGS. 2-4, 7-8, and 10-12 showing the next step in installation of a preferred embodiment of the system of the present invention wherein the thermal breaks are installed.
Figure 12:
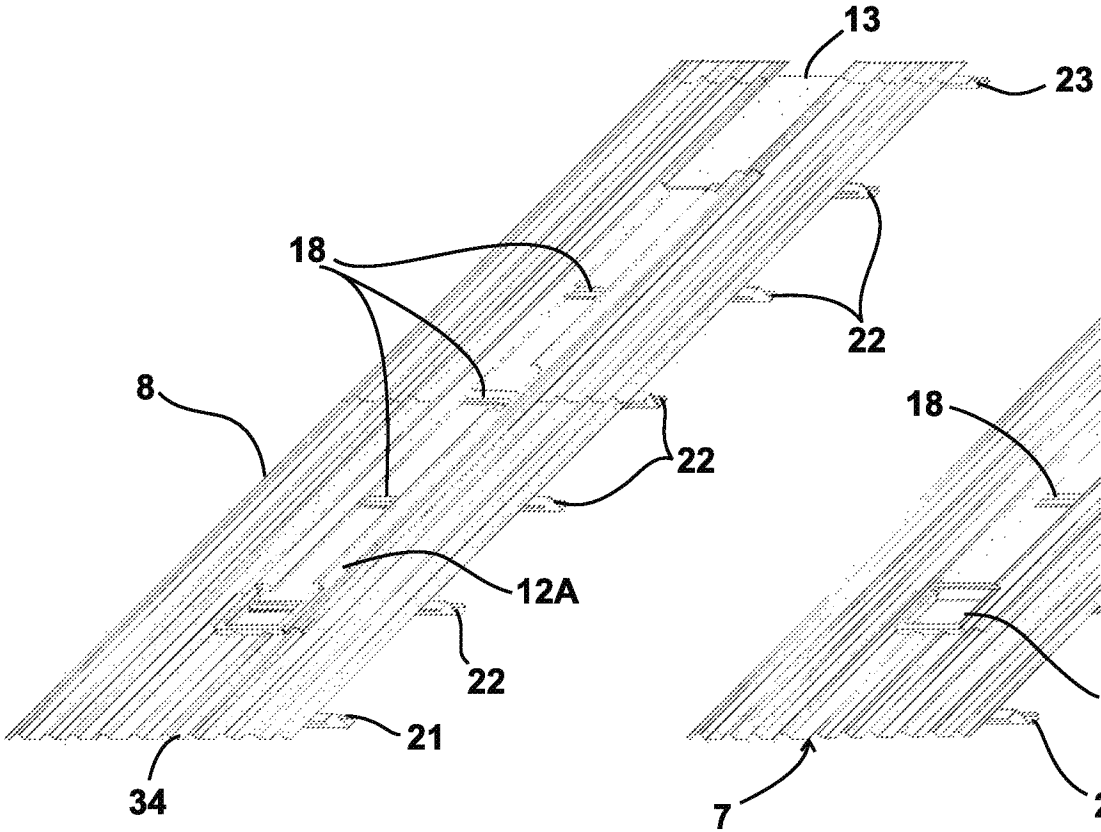
FIG. 12 is a perspective view of the bay of FIGS. 2-4, 7-8, and 10-11 showing the next step in installation of a preferred embodiment of the system of the present invention wherein a side rail is installed.
Figure 14:
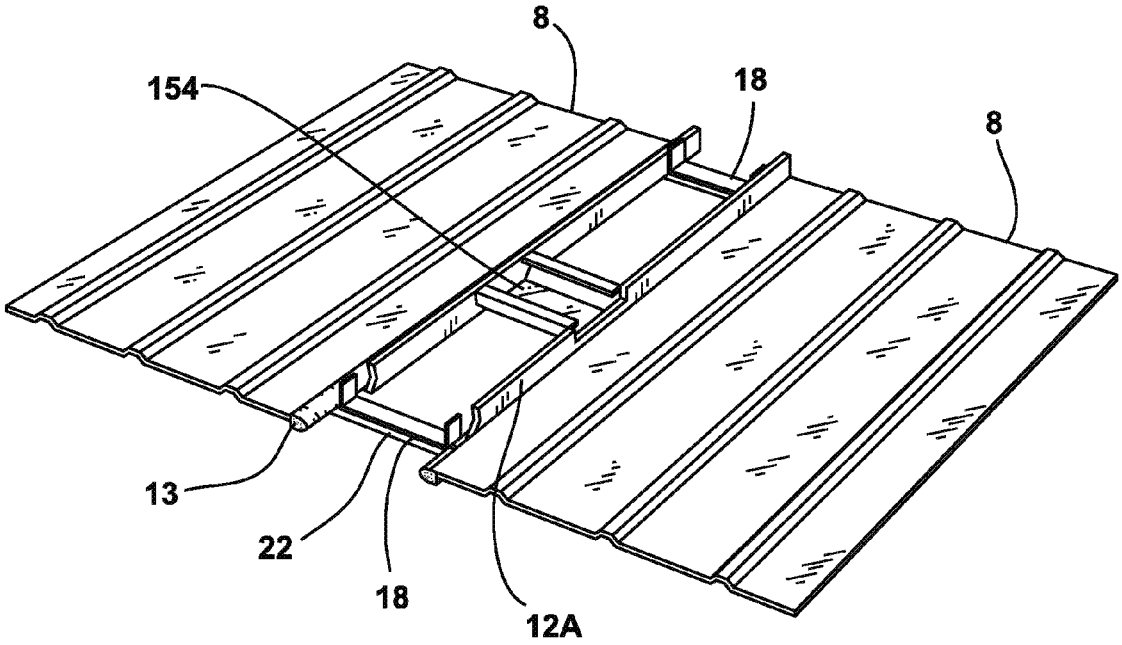
FIG. 14 is a close up view of the installation of thermal breaks shown in FIG. 13.
Figures 15, 16:
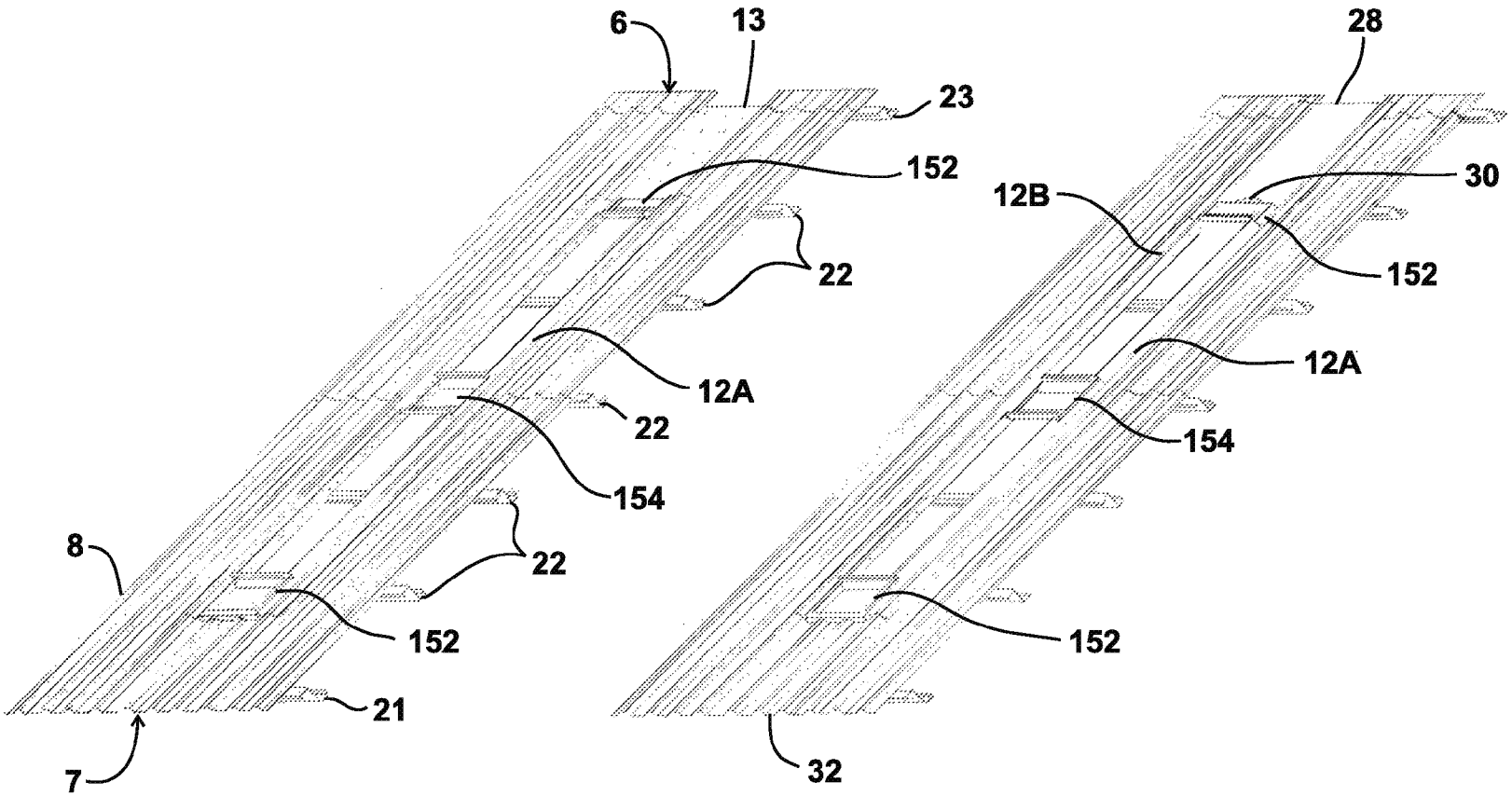
FIG. 15 is a perspective view of the bay of FIGS. 2-4, 7-8, and 10-13 showing the next step in installation of a preferred embodiment of the system of the present invention wherein the second side rail is installed.
FIG. 16 is a perspective view of the bay of FIGS. 2-4, 7-8, 10-13, and 15 showing the next step in installation of a preferred embodiment of the system of the present invention wherein the ridge or starter panel is installed.
Figures 17, 18:
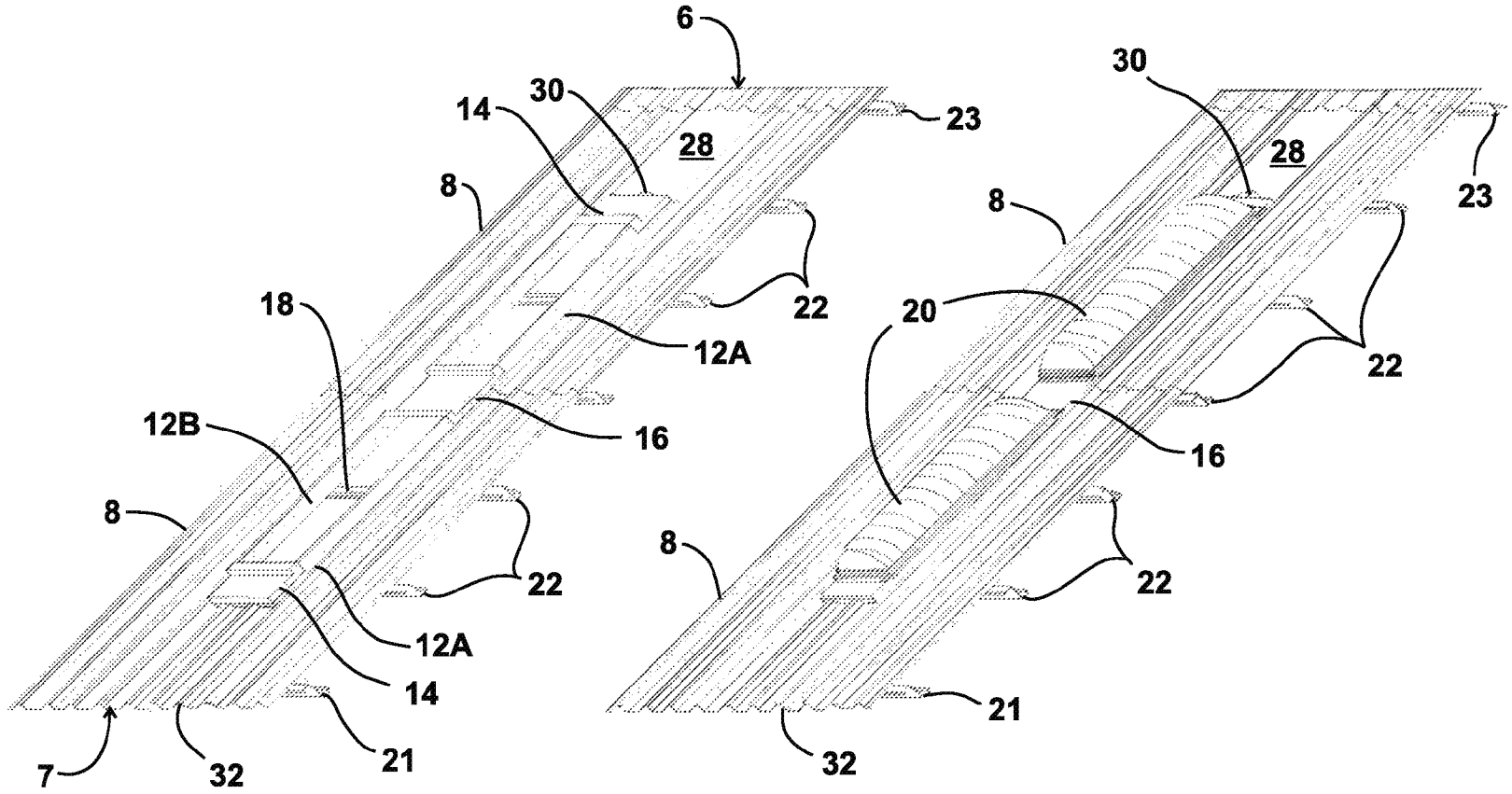
FIG. 17 is a perspective view of the bay of FIGS. 2-4, 7-8, 10-13, and 15-16 showing the next step in installation of a preferred embodiment of the system of the present invention wherein the middle and end caps are installed.
FIG. 18 is a perspective view of the bay of FIGS. 2-4, 7-8, 10-13, and 15-17 showing the next step in installation of a preferred embodiment of the system of the present invention wherein the skylights are installed.
Figure 19:
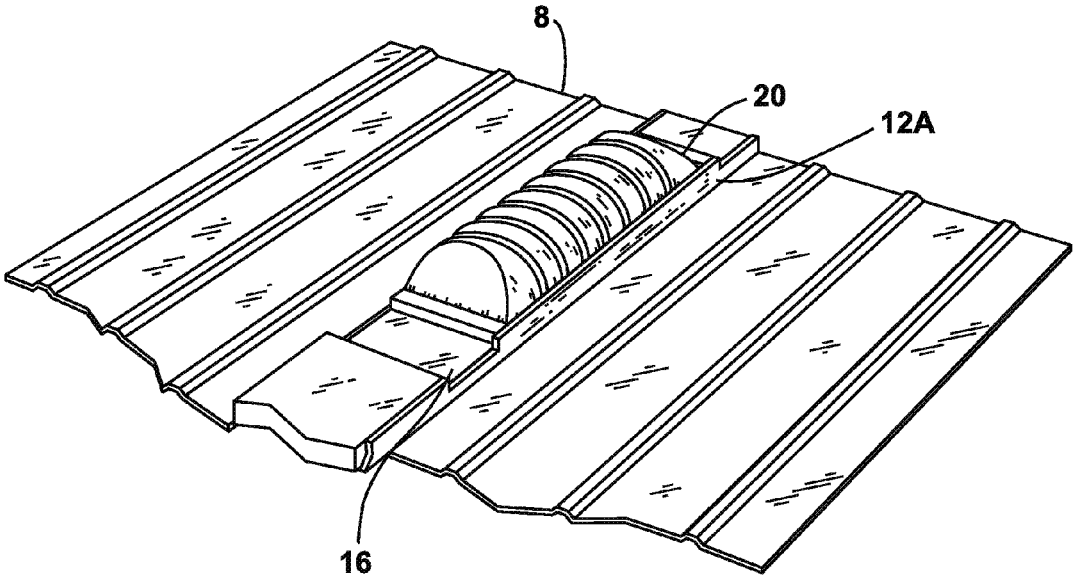
FIG. 19 is a close up perspective view of the skylight installation of FIG. 18.

To install an in-line curb on an existing R-panel roof, an R-panel 8 from a desired location is removed as shown in FIG. 4. If there is batt insulation 13 present, then it is cut down the middle for the entire length of the open space (see FIGS. 5-6). Both halves of the insulation 13 are folded over onto the existing metal panels 8 as shown in FIG. 8. The mounting brackets 18 are screwed onto each roof purlin 22 as shown in FIGS. 8-9. After mounting brackets 18 are installed, the insulation 13 is folded back over onto the mounting brackets 18 as shown in FIG. 10. The eave panel 32 is installed and fastened to its mounting bracket 18 as shown in FIG. 11. A first side rail 12A is installed with the "panel interface legs" 38 placed either over or under the existing R-panel side seams as shown in FIG. 12. The system of the present invention may be installed so that the rails and thus the curb sits above the existing panels 8 or below. It is preferred in most instances, to install the rail 12 and curb above the existing panels 8, but either installation is available. The batt insulation 13 is rolled and held in place by the side rail 12 and mounting bracket 18. Thermal breaks 152, 154 are installed next at the low points in the installed rail 12A as shown in FIGS. 13 and 14. Then the second side rail 12B is installed as shown in FIG. 16. Both side rails 12A, 12B are attached to the mounting brackets 18. If a run requires additional side rails 12, then the additional rails are installed over-lapping the fastened side rails. Once the rails 12 reach a desired point, the starter panel 28 is positioned and then fastened to its mounting bracket 18 as shown in FIG. 16. The end caps 14 and middle caps 16 are installed and fastened to the side rails 12 or starter/eave panel 28/32 as shown in FIG. 17. Finally, the skylights 20 are mounted and fastened to the completed assembly as seen in FIGS. 18-19.

For new metal roof installations, the same procedure is followed once the desired run location has been reached by the install crew as they install the new panels.

The in-line curb system 10 of a preferred embodiment may comprise 5 major components; the rails 12, the caps 14, 16, starter panel 28, eave panel 32 and mounting brackets 18, for example.

Figure 34:
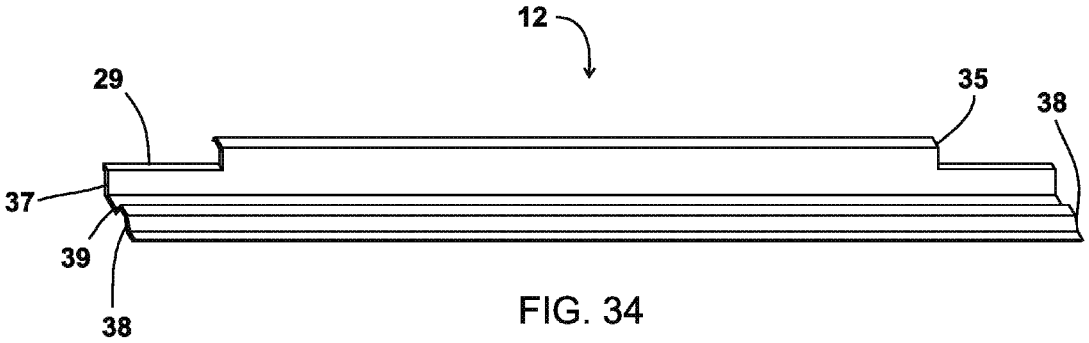
FIG. 34 is a perspective view of a preferred embodiment of the side rail of the present invention.
Figure 35:
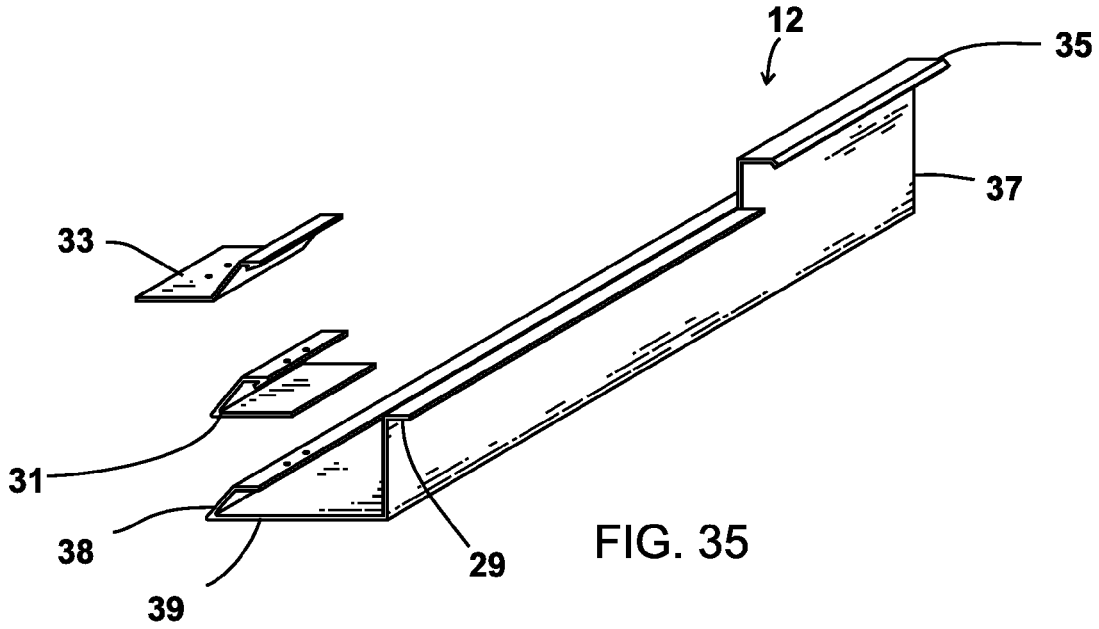
FIG. 35 is an exploded view of a preferred embodiment of the side rail of the present invention with two possible clips.
Figure 36:
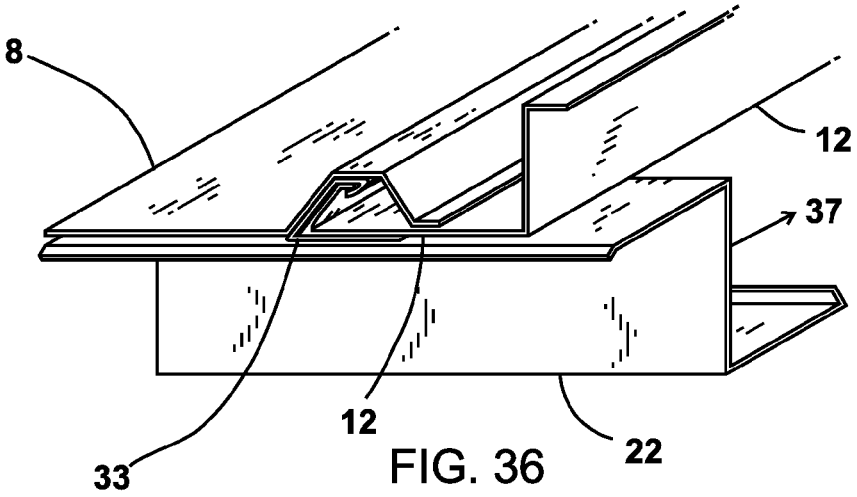
FIG. 36 is a side perspective view showing the side rail and hidden clip of FIG. 35 as installed on a purlin with a panel.
Figure 37:
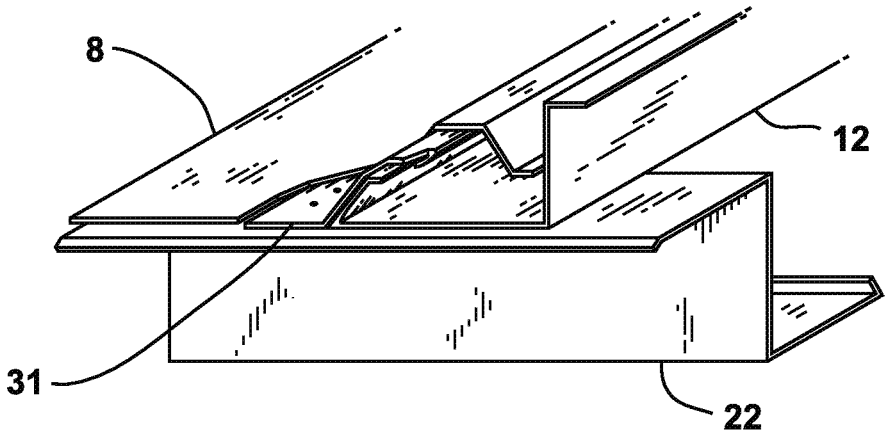
FIG. 37 is a cut away view of the side rail and exposed clip of FIG. 35 as installed on a purlin with a panel.
Figure 38:
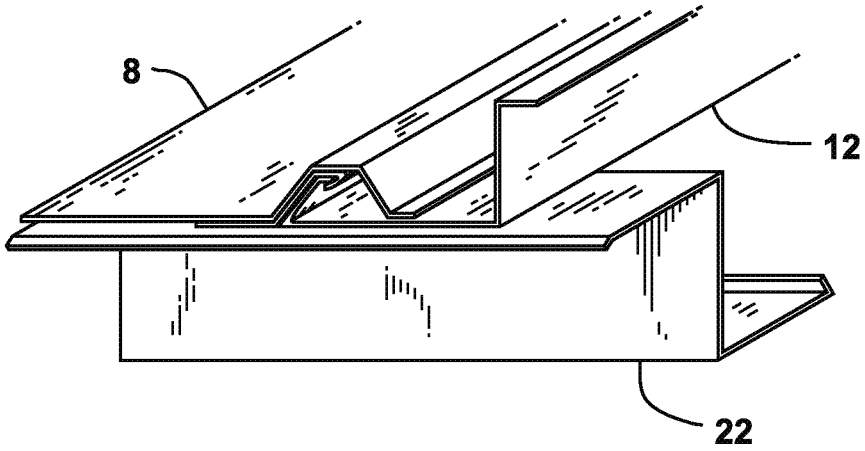
FIG. 38 is a perspective view of the side rail and hidden clip of FIG. 35 as installed on a purlin with a panel.
Figure 58:
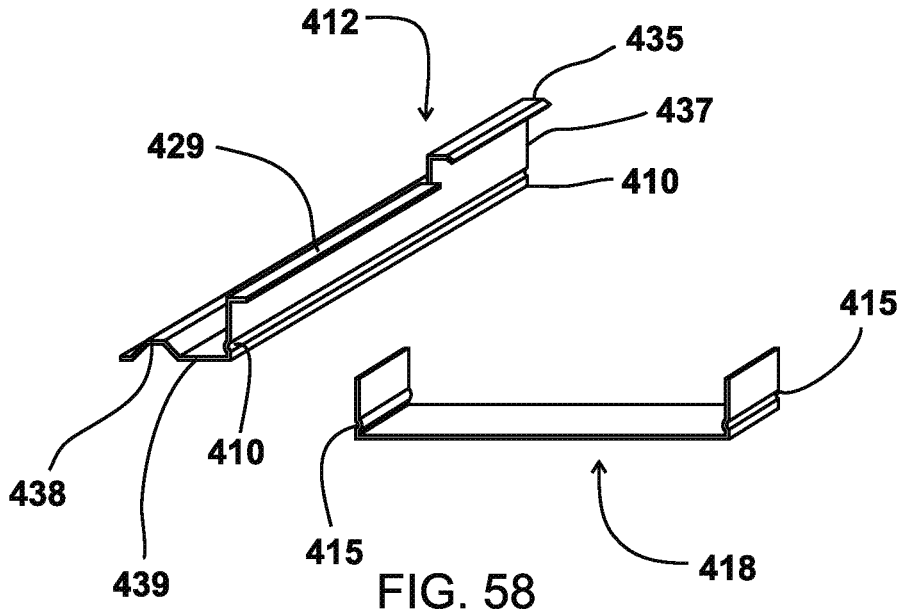
FIG. 58 is an exploded view of a preferred embodiment of the side rail and mounting bracket of the present invention having conduits.

The side rails 12 of the in-line curb system may be made of 18 gauge steel, for example, but other gauges can be utilized as well as other type of materials such as aluminum and stainless steel. The side rails 12 can be made to any length, but 11 feet (3.3528 meters), 21 feet (6.4008 meters) and 31 feet (9.4488 meters) are expected to be standard lengths. The side rails 12 can be over-lapped to accommodate longer runs. A preferred embodiment of the present invention may comprise four major parts to the side rail 12 (see FIG. 34): the panel interface leg 38, the valley 39, the vertical wall 37, and the top flange 35, for example. In some embodiments, the rail 12, 41, 341, 412 may further comprise vent holes as seen in FIGS. 51-55 and/or a conduit 410, 415 as shown in FIG. 58. The vertical wall 37 of the side rail 12 preferably has a raised portion 24 for accepting a skylight 20 or other device, and lower portions for accepting the thermal breaks 152, 154 and/or caps 14, 16.

The panel interface leg 38 preferably matches the cross-section of whichever type of metal panel is being used on the roof (see FIGS. 24-31). The roof panel interface leg 38 preferably may go over or under the side seams of the existing roof's panels. The interface leg and panel's side seam may then be "stitched" together using typical roofing screws 55 or standing seam lock, for example. Alternatively, clips or fasteners 31, 33 may be used for securing the rail 12 to the panels 8 as seen in FIGS. 35-38. At each purlin 22 location, both the roof panel side seam and interface leg are fastened down to the purlin using a typical roofing screw or standing seam clip, for example. The interface leg can be configured during manufacturing to match the side seam of any panel profile.

The valley 39 area of the side rail 12 allows water to flow down the slope of the curb system 10 without impeding the water flow. The width of the valley 39 may be decreased or increased depending on the size requirement of the skylight 20. As the width of the skylight 20 increases, the valley width preferably decreases to assure that the roof panel interface leg 38 always is positioned correctly underneath the existing roof panel side seam. Since the trapezoidal ribs of an R-panel are 12 inches (30.48 centimeters) apart in certain embodiments, the valley widths gets less than an 1 inch (2.54 centimeters) due to increase in skylight width, the valley width will preferably jump to the next increase of 6 inches (15.24 centimeters) (two rails at 6 inches (15.24 centimeters) equals 12 inches (30.48 centimeters) overall), for example.

The vertical wall 37 of the side rails may be adjusted to meet any height requirements, but is expected to be approximately 6 inches (15.24 centimeters) tall. The side walls 12 may be attached to the mounting brackets 18 via self-tapping roofing screws (see FIG. 18). The frame of the domed skylight 20 is preferably also attached to the side walls 12 using self-tapping screws with washers, for example. Where the end 14 and middle caps 16 are positioned, the vertical wall 37 may be cut down by approximately 2 inches (5.08 centimeters) to facilitate the proper seating of the caps 14, 16 in certain embodiments, for example.

The top flange 35 of the side rail 12 provides a flat surface for sealing the bottom of the skylight frame to the curb. Most domed skylights 20 have an insulated thermal break via gasket material. This gasket material would sit on the top flange 35 of the side rail 12.

Both the end caps 14 and middle caps 16 attach to the side rails 12 in a preferred embodiment. Preferably, the sides 3, 17 of the caps 14, 16 are designed to mate with the bottom flange 29 of the side rail 12. The rails 5, 19 of the caps 14, 16 are designed to mate with the skylight 20 or other device. The rails 5, 19 of the caps 14, 16 preferably continue the top flange 35 of the side rails 12A, 12B such that there is a generally continuous curb for mating with and supporting the skylight 20 or other device to be installed. The caps 14, 16 have middle sections 1, 15 that appear generally flat in the figures, but may be any design or shape as needed for the installation. Preferably, the end caps 14 have a coupler 9 that mates with the coupler 26 of the eave panel 32 and/or the coupler 27 of the starter panel 28. Both caps 14, 16 serve a similar purpose: they complete the enclosure of the end of the curb as it relates to the bolting of the skylight frame to the curb. The side rails 12 create the sides of the skylight curb and the caps 14, 16 create the front and back portions of the skylight curb in a preferred embodiment. There are two end caps 14 per in-line curb run in a preferred embodiment, for example. One end cap 14 is fastened to the eave panel 32 making up the back wall of the last skylight 20 and the second end cap 14 is fastened to the starter panel 28 making up the front wall of the first skylight 20. The middle cap or caps 16 may be installed between all skylights 20 creating the back wall of one skylight and the front wall of the next skylight. If there is only one skylight, then both end caps 14 will be used however no middle cap 16 will be used. The top portion of the caps mimics the top flange 35 of the side rail 12 providing a flat surface for sealing of the bottom of the skylight frame. See FIGS. 20-24.

Figure 44:
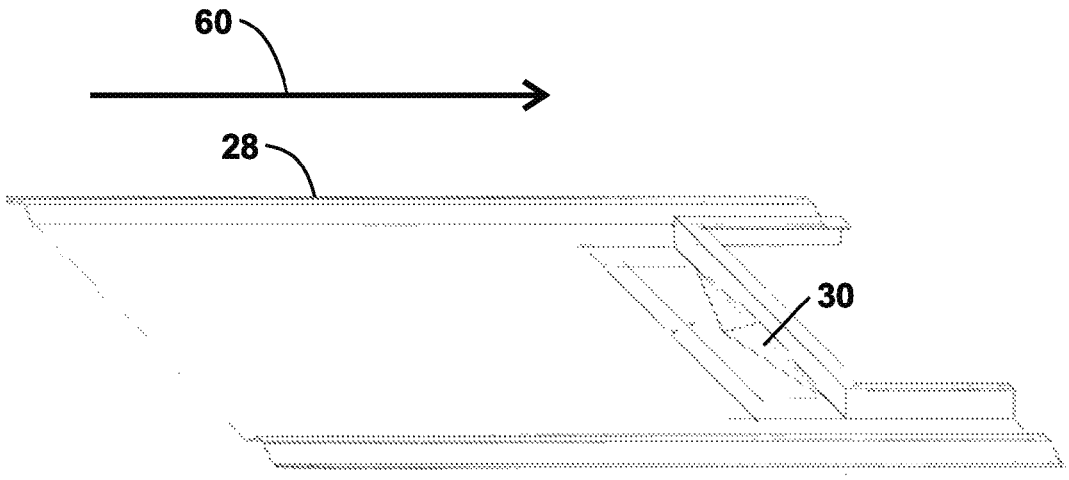
FIG. 44 is a perspective view of a preferred embodiment of the ridge or starter panel of the present invention.
Figure 45:
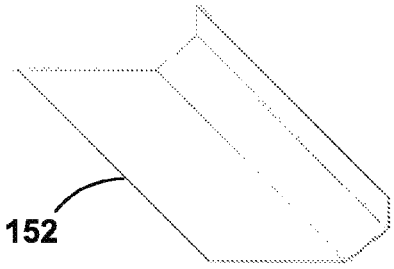
FIGS. 45-50 show various embodiments of the thermal breaks of the present invention.
Figure 46:
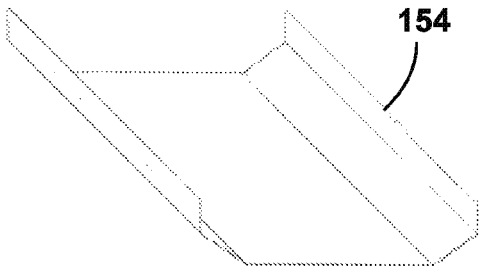

The starter panel 28 may be made of 20 gauge (approximately 0.953 millimeters thick) steel, for example, but can be made of different gauges (millimeters thick) of steel and different materials. The starter panel 28 ties in the top of the roof system 10 to the side rails 12. The starter panel 28 may be positioned under the ridge cap 50 or, if used as a single skylight 20 system further down the slope, then the starter panel 28 will preferably be positioned under the R-panel coming from the ridge 6. The starter panel 28 may also have a small metal cricket 30 at the base of the end cap 14 housing to deflect water towards the valleys 39 of the side rails 12 (see FIG. 44). The starter panel 28 preferably has the same side seam roof panel interface legs 36 as the side rails 12 which allows for over-lapping of the starter panel 28 and the side rails 12. The starter panel 28 also houses the end cap 14 for the first skylight 20, which are joined by a coupler 27 on the starter panel 28 that mates with the coupler 9 and sides 3 of the end cap 14. This panel is fastened to the mounting brackets 18 and interface legs in a preferred embodiment.

The eave panel 32 may be designed just like the starter panel 28, but without the metal cricket 30, for example. It functions in the same way as the starter panel 28 and is attached in the same manner. The eave panel 32 houses the end cap 14 for the last skylight 20. Preferably, the eave panel 32 has a coupler 28 that mates with the coupler 9 and sides 3 of the end cap 14.

Figure 42:
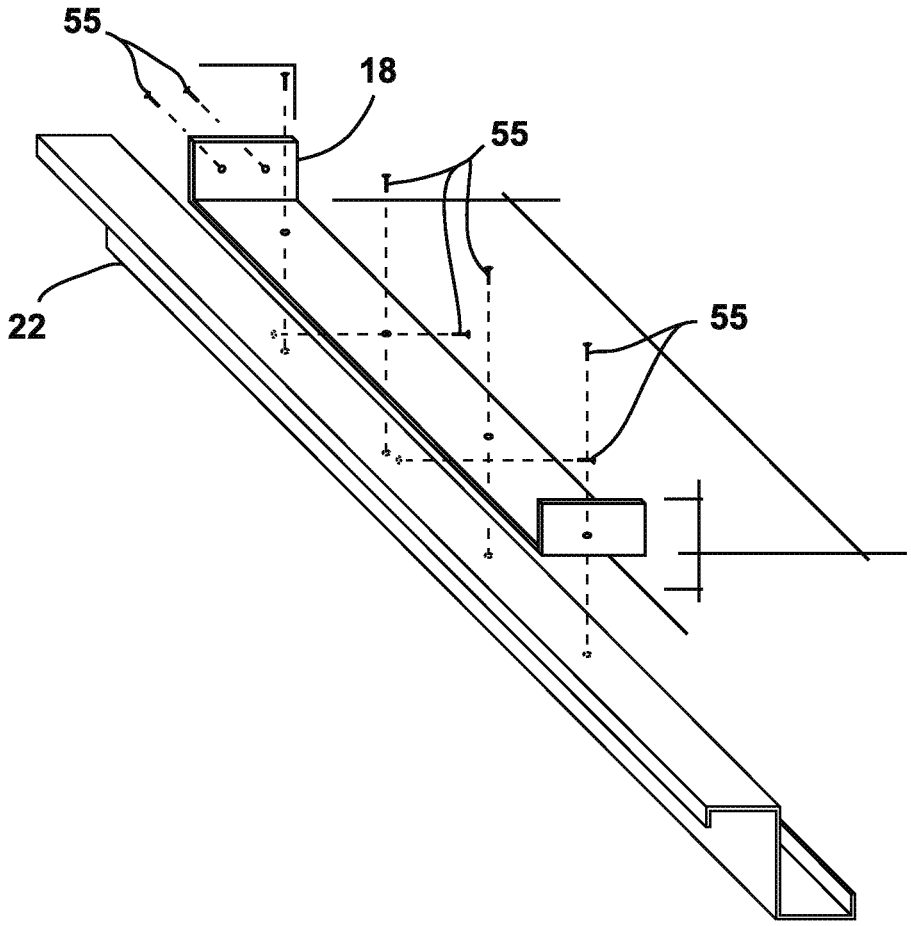
FIG. 42 is an exploded view of a preferred embodiment of the mounting bracket and screws of the present invention as installed on a purlin.
Figure 43:
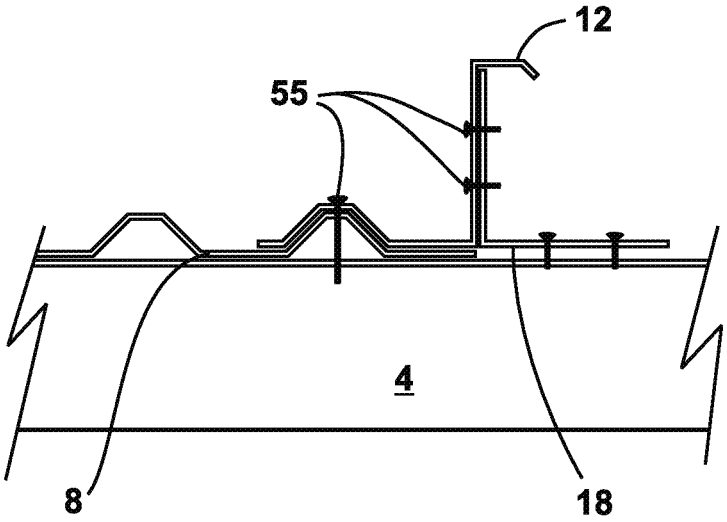
FIG. 43 is a profile view of preferred embodiments of the mounting bracket and side rail of the present invention as installed on a purlin and panel.

The mounting bracket 18 is expected to be made from 16 gauge (approximately 1.59 millimeters thick) steel, but can be made of different gauges (millimeters thick) of steel and different materials based on the requirements of each location. The mounting brackets 18 may be screwed to each purlin 22 that is covered by the in-line curb system 10. Preferably, the mounting bracket has a middle section 68 that engages the purlin 22 between two generally parallel sides 69 that engage the rails 12A, 12B as shown in FIGS. 42-43. As shown, the mounting bracket 18 appears generally flat in the middle portion 68; however the shape of the bracket 18 may be altered depending on the needs of a particular installation. The mounting bracket 18 is designed to be attached to both the top flange of a roof's purlin 22 and the purlin's side wall using, for example self-tapping roofing screws (see FIGS. 42-43). The in-line curb system 10 may attach to the mounting brackets 18 via screws through the vertical walls. The dimensions of the mounting bracket 18 can be altered to accommodate different size and width requirements as well as panel profiles.

Most interior spaces of metal buildings are vented through vents placed along the ridge line. Equipment exhaust is usually directed through metal roofs requiring the penetration to be flashed to prevent leaks. Most of the time, these flashed penetrations block water flow leading to premature rusting and failure of the roof system.

The roof vent system 40, 210, 340 of the present invention allows for better venting of the interior space as well as plumbing vents, furnaces and other equipment. Instead of mounting the vents across the ridge, the vents of the present invention are mounted along the line of the slope of the roof (from ridge to eave). When the vent system 40, 210, 340 is mounted along the front and back of the building following the slope of the roof line, then the side rail walls act as a parapet wall lowering the overall roof attachment requirements. On most metal buildings, running the vents along the slope will increase the amount of venting capacity when compared to a single line of ridge vents. If additional venting is desired, then another run of vents can be added to the midline of the building's roof.

The roof vent system 40, 210, 340 of the present invention also eliminates plumbing and equipment pipes from penetrating the roof system. By routing the exhaust piping 48, 248 into one of the curb vents, the gases are dissipated through the vent holes 44, 244 running along the entire length of the curb rail 41 (see FIGS. 51-55). This vent system may also be installed in the walls of the building. When installed in this way, the direction of the vent holes 44, 244 is altered to prevent weather from allowing water to enter the building. Additionally, when installed in the wall of the building, the vents provide gutter support, which allows the gutter to be installed at an angle rather than horizontal, further improving water flow away from the building interior.

In a preferred embodiment, the same base components as the in-line curb system outlined above are used in the venting system design 210. There may be a couple of modifications to the side rails 212 and the cap 242.

The flange 245 of the side rails 212 are turned out towards the valley 239 in a preferred embodiment. This outturning of the flange 245 prevents wind-driven rain from entering the vent holes 244 and also allows attachment of a one-piece cap 242. If any piece of equipment's exhaust needs to extend higher, then it can be plumbed through the cap 242 and flashed accordingly. The side rails 212 may also have vent holes 244 running along the top of the vertical wall 243.

An alternative embodiment of the present in-line curb system is for low-slope applications. The in-line curb system will allow multiple skylights to be attached to the curb while also facilitating roof drainage and minimizing the taper requirements of open, large-area roof designs. When multiple in-line curb systems are installed in a grid like pattern on a large area roof, the tapered insulation required to adequately remove rain water will be reduced due to shorter runs of overall slope. The in-line curb system for low-slope applications incorporates the same components as that of the R-panel design.

The material used to form the side rails and caps is expected to be stainless steel, but other metals can be used as well as any combinations of non-metal materials. The side rails and caps could have modifications from the R-panel design to allow installation and enhancements geared to the low-slope market.

With respect to low-slope side rails, the interface leg may be designed to allow the low-slope membrane to be easily attached to it. The interface leg will be sloped to match the level of insulation layer. The valley area of the side rail will preferably be deeper set when compared to the interface leg and vertical wall creating a gutter effect. The valley area will also be increased to a width to adequately accommodate water drainage from the roof area. The vertical wall height will preferably be increased to allow for an 8 inches (20.32 centimeters) height above the top layer of the roof membrane, for example. In heavy snow areas, electric heating elements can be added to the interior side of the vertical wall allowing the side rail walls to be kept above a freezing level.

The skylights typically used on low-slope applications are wider than those typically used on metal roofs. Therefore, it is expected that the caps for the side rails will match the wider requirements. The caps may also be shaped to allow plumbing vents to be exhausted through them.

Figure 47:
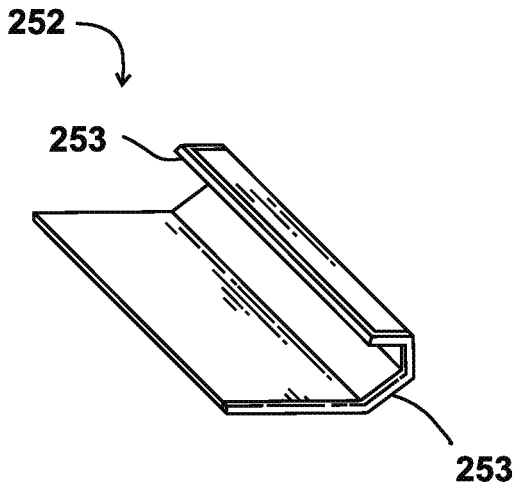
Figure 48:
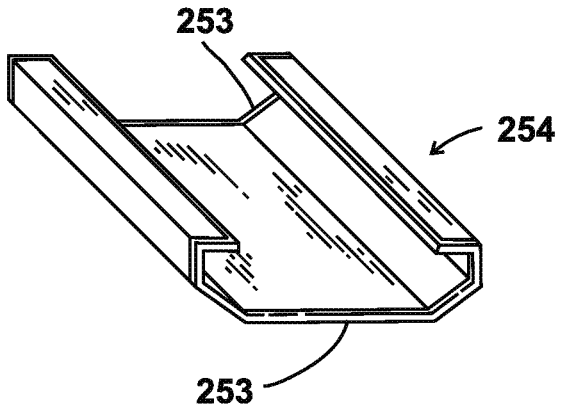
Figure 49:
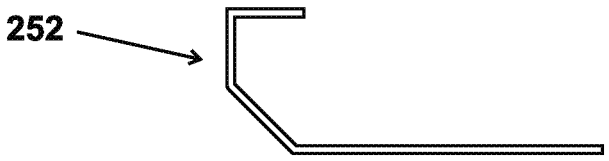
Figure 50:
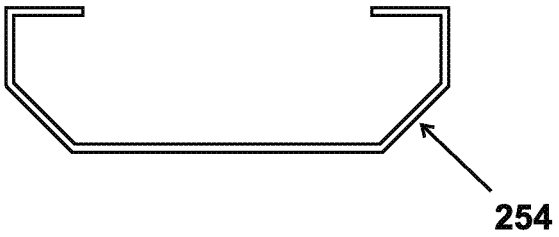

The thermal break panels 152, 154 are preferably installed beneath all of the caps 14, 16 when the application calls for insulated units. The thermal break panels 152, 154 provide an insulating air gap separating the exterior-exposed cap metal from interior building temperatures. The thermal break panels 152, 154 also act as a catch basin for any minor water leaks coming from the cap seals if a high negative-pressure is experienced inside the building. Additionally, the thermal break panels 152, 154 hold the batt insulation 13 in place against the rail's vertical wall 37. The thermal break panels 152, 154 are expected to be made from 26 gauge (approximately 0.478 millimeters thick) sheet steel, but other materials and/or thicknesses can be used to make the thermal break panel. For example, steel often catches and/or rips the insulation 13. Therefore, various types of plastics are often used for thermal breaks 152, 154. However, plastics often cost more than steel; thus, as an alternative, the thermal breaks 252, 254 may be made with steel and also include a gasket 253 for preventing catching and tearing of insulation 13. See for example, FIGS. 47-48.

If a starter panel 28 or eave panel 32 has to be cut short to accommodate more skylights 20 than a limited run would allow, then for example two 6-foot (1.8288 meters) lengths of roof panel interface leg 38 can be used beneath the short starter or eave panel's interface leg to provide support to the short panels. This length of interface leg 38 is called a "bridge" 160 (not shown in drawings). The bridge 160 is preferably about six feet (1.8288 meters) long and they span from one of the building's Z purlin to the next Z purlin (not shown). The bridges 160 are expected to be made from 18 gauge (approximately 1.27 millimeters thick) sheet steel, but other metals and thicknesses could be used.

In other embodiments, when the Starter 28 and/or Eave Panels 32 are cut shorter than the span of the roof supports (Z-purlin and/or web joist), Bridges 160 will have to be installed on both sides of the Panel's interface legs to provide panel support. The Bridges 160 span the roof supports reinforcing the shorter Starter/Eave Panels 28/32. The Bridges 160 will have the same shape as the interface leg sections 36/34 of the Starter/Eave Panels 28/32 and is expected to be made out of the same type and gauge of metal as that of the in-line curb system 10. The lengths of the Bridges 160 are preferably about 12 inches (30.48 centimeters) longer than the span of the roof supports.

Buildings with a roof system that have a curve to the field of the roof from the ridge line to the eave are considered radius roof systems. With some modifications to the in-line curb system, a radius curb system can be added to a radius roof This may include modifications to the end panels, side rails, caps, thermal breaks and mounting brackets.

FIG. 2 shows the skeleton of one bay of a metal-roof building prior to installation of the roof and curb apparatus which is designated generally by the numeral 10 in other figures. In FIG. 2, one bay 2 is the section from one main building support 4 to the next main building support 4. Skylights 20 are typically positioned in the middle of the bay 2 between the ridge 6 and eave 7. Purlins 22 are spaced between the main roof supports 4 with the eave purlin 21 closest to the eave 7 and the ridge purlin 23 closest to the ridge 6 as seen in FIG. 3. The purlins 22 shown can be Z-purlins, however other suitable purlins may be used.

FIG. 3 shows the roof bay 2 of FIG. 2 with the R-panels 8 in place. These figures show a roof panel such as an R-panel 8 though other roofing panels or options may be used with the apparatus of the present invention 10. R-panels have highs 9A, and lows 11. R-panels 8 are typically 3-foot (91.44 centimeters) panels with a 12-inch (30.48 centimeters) span from center of one high 9A to center of next high 9A. It should be understood that the roof components seen in FIGS. 2-6 are known and commercially available.

The roof system 10 of the present invention is considered a "through screw" attachment meaning that the screws (not shown) used to attach the R-panels 8 to the purlins 22 go through the panel 8, insulation 13, and purlin 21, 22, 23. However, this system 10 is different than other roofs in the industry in that there are preferably no screws in the lows 11 of the R-panels 8. Screws can be used in the tops of the highs 9A and in the side walls of the brackets 18, preventing a common leaking cause among prior art roof systems. Insulation 13 is draped across the purlins 21, 22, 23 as shown in FIG. 2.

Figure 5:
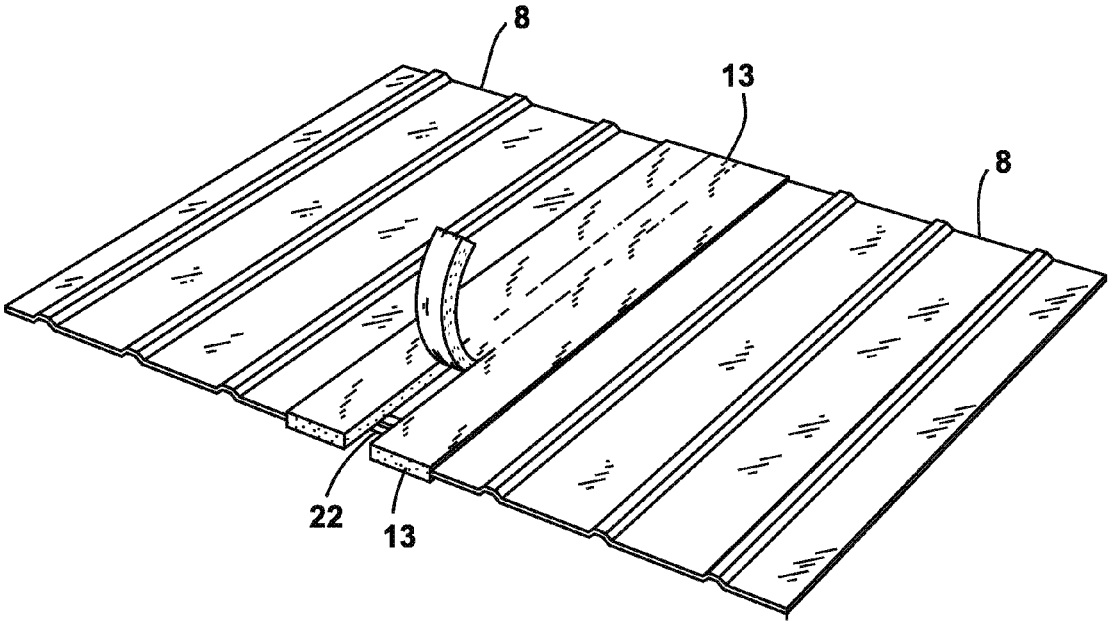
FIGS. 5-6 are close up views of the insulation being cut and folded back prior to skylight installation.
Figure 6:
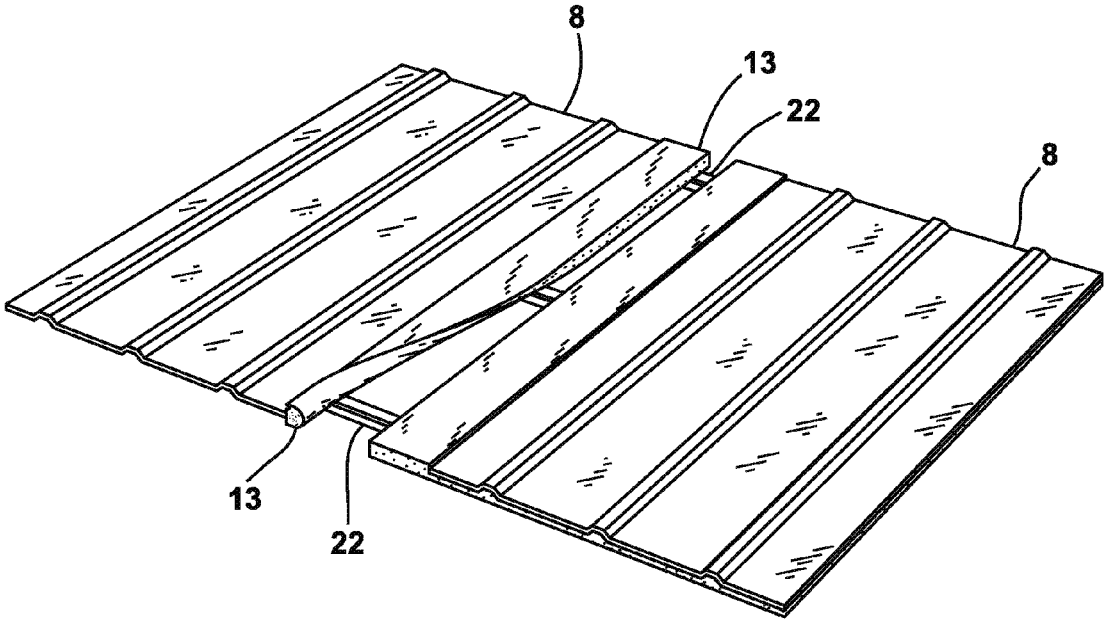
Figure 7:
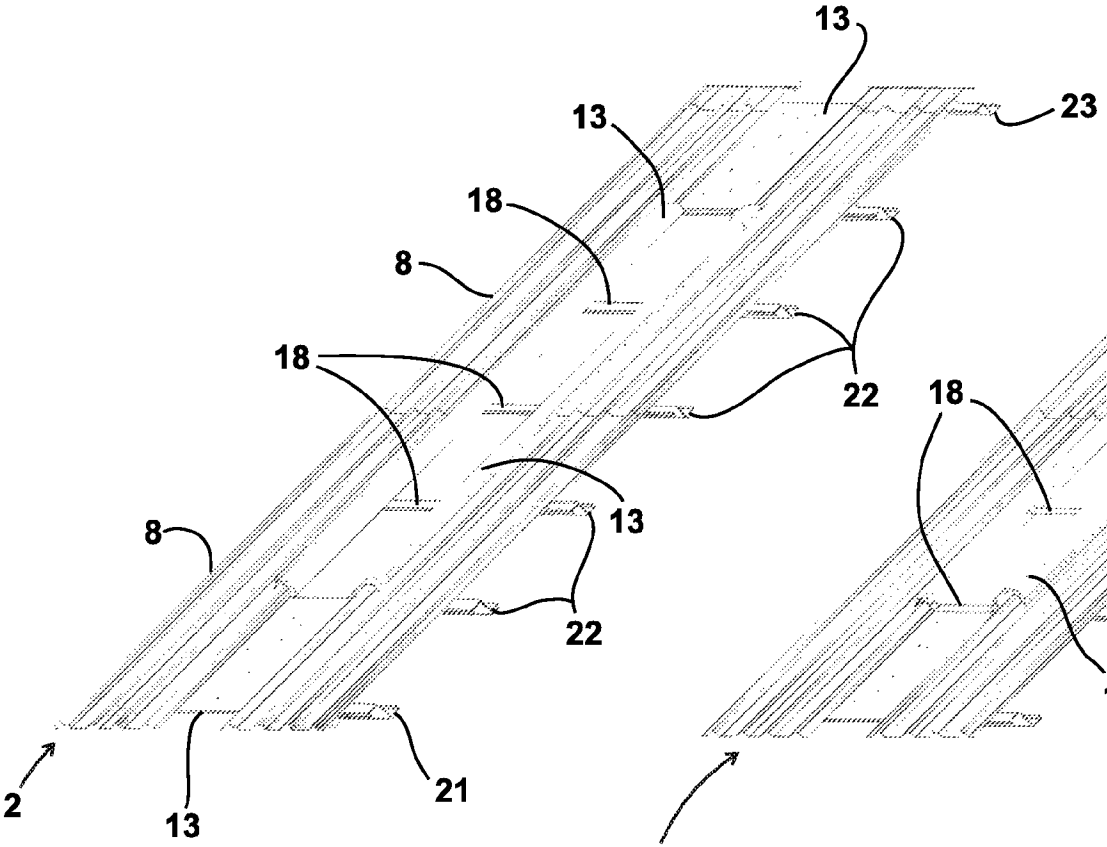
FIG. 7 is a perspective view of the bay of FIGS. 2-4 showing the insulation folded back.

To install skylights 20 using the preferred embodiment of the apparatus/curb system of the present invention 10, R-panels 8 in the center of a bay 2 are removed to provide a "cut-out" and revealing the draped insulation 13, as shown in FIG. 4. The insulation 13 is then cut down the center as shown in FIGS. 5-6 and pulled away from the center of the bay 2, and over the remaining r-panels 8 as shown in FIG. 7.

Mounting brackets 18 are installed over the purlins 22 as shown in FIGS. 8-9 (FIG. 8 does not show both the mounting brackets 18 and the purlins 22 as they would not both be visible; however, FIG. 9 shows where both brackets 18 and purlins 22 would be located at this stage in an installation).

After mounting brackets 18 are installed, the insulation 13 that was folded over the R-panels 8 is then folded back over the mounting brackets 18 as shown in FIG. 10. The insulation that is exposed below the "cut-out" will be covered by the eave panel 32 as shown in FIG. 11. Eave panel 32 can be a shorter section of R-panel 8. The folded insulation 13 will be folded into a first side rail 12A when it is installed as shown in FIG. 12.

The preferred embodiment (apparatus and method) of the present invention 10 uses thermal breaks 152, 154 under preferably metal caps 14, 16 to help prevent condensation from forming on the skylights 20 and roof system components. The thermal breaks 152, 154 will also serve to catch any condensation that does form before it drips into the roof structure and/or building. Thermal breaks 152, 154 are installed after installation of eave panel 32 and first side rail 12A as shown in FIGS. 13-14. A thermal break end 152 is installed at the eave 7 end and ridge 6 end of the roof and thermal break middles 154 are installed in the remaining spaces between skylight openings.

A second side rail 12B is installed, spaced from first rail 12A. The remaining insulation 13 is folded inside it as shown in FIG. 15. A ridge and/or starter panel 28 is then installed over the exposed insulation remaining at the ridge 6 as shown in FIG. 16. Starter panel 28 can be a shorter section of R-Panel 8. The ridge/starter panel 28 preferably has a cricket 30 for drainage of water and condensation, and does not need to have intermediate ribs (highs 9 and lows 11 like the R-panels 8) in order to prevent damming of water and/or condensation as is found in other skylight systems.

End caps 14 are installed at the ridge 6 and eave 7 ends of the skylight openings. Middle caps 16 are installed in spaces between skylight openings as shown in FIG. 17. The end caps 14, middle caps 16, and side rails 12 create the "curb" system that the skylights 20 attach to as shown in FIG. 18.

The present invention includes a roof apparatus 10, comprising a roof framework including multiple roof supports 4, purlins 22 that span between said supports 4, roof panels 8 covering the purlins 22 and roof supports 4, wherein the roof has an uppermost ridge portion 6 and a lower eave portion 7; a plurality of skylights 20 mounted to said roof framework; an interface that is supported by the roof framework and that supports the skylights 20 at positions spaced above the framework. The interface preferably comprises two side rails 12A, 12B, each having grooves 38 for mating with the grooves of the roof panel 8; a first end cap 14, one or more middle caps 16, and a second end cap 14; a plurality of mounting brackets 18 configured to attach to the side rails 12A, 12B; a starter panel 28 having grooves 36 for mating with the grooves 38 of the side rails and the existing roof panels 8 and a coupler configured to receive an end cap 14; an eave panel 32 having grooves for mating with the grooves 38 of the side rails and the existing roof panels 8 and a coupler configured to receive an end cap 14; and a second end cap 14 configured to mate with an under surface of a said skylight 20, the two side rails 12A, 12B, and the coupler of the eave panel 32. Preferably, the starter panel 28 has a cricket 30 to deflect water towards the grooves 38 of the side rails. The first end cap 14 is configured to mate with an under surface of a skylight 20, the two side rails 12A, 12B, and the coupler. The middle caps 16 are placed between two of said skylights 20;

The roof apparatus 10 of the present invention preferably is incorporated into an existing metal building having a roof framework including multiple roof supports 4, multiple purlins 22 that span between said roof supports 4, a ridge portion 6, an eave portion 7, and multiple roof panels 8 supported by the roof support 4 and purlins 22. Preferably, the panels of the metal building are R-panels; however, the present invention may be used on any type of metal building supplies. The apparatus 10 may include one or more skylights 20 supported by an interface in between the skylights 20 and the roof framework 4. The interface preferably includes two side rails 12A, 12B configured to receive the one or more skylights 20, wherein the side rails 12A, 12B preferably have grooves 38 for mating with the grooves of the roof panels 8. The interface preferably includes first and second end caps 14. The interface also includes a plurality of mounting brackets 18 configured to attach to the purlins 22 and to the side rails 12A, 12B. The interface also preferably includes starter panel 28 that is placed near the ridge portion 6 of the roof and has grooves 36 for mating with the grooves 38 of the side rails 12A, 12B. The first end cap 14 is preferably configured to mate with an under surface of skylight 20, the two side rails 12A, 12B, and the starter panel 28. The interface also preferably includes an eave panel 32 that has grooves 34 for mating with the grooves 28 of the side rails 12A, 12B, and a second end cap 14 configured to mate with an under surface of a skylight 20, the two side rails 12A, 12B, and the eave panel 32.

Figure 56:
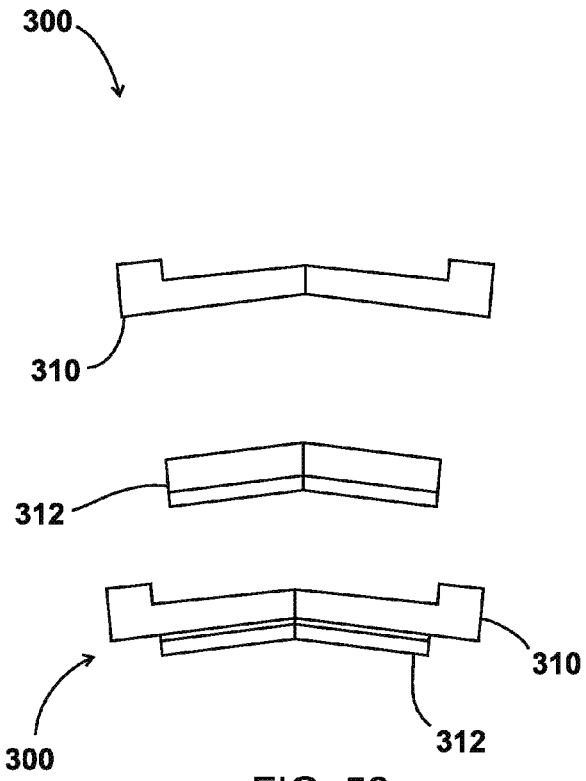
FIG. 56 is an exploded side view of an alternate embodiment of the ridge or starter panel and cap of the present invention.
Figure 57:
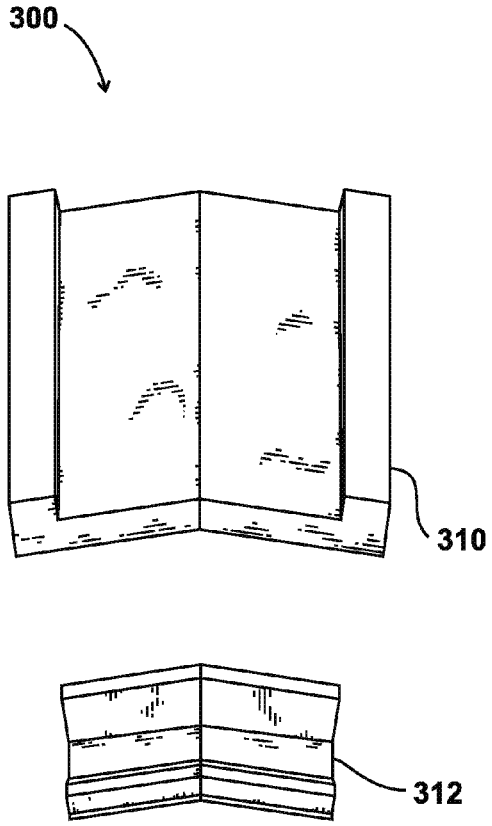
FIG. 57 is an exploded top perspective view of the embodiment of the ridge or starter panel and cap of the present invention shown in FIG. 56.

Alternatively, the starter panel 28 may be replaced with a ridge side rail 312 as shown in FIGS. 56-57. In this embodiment, the first end cap is replaced with a ridge cap.

Additionally, the figures show and the above description discusses an installation including a skylight; however, any other roof top equipment could be installed such as an HVAC, lighting units, or ventilation systems. Furthermore, the present invention may also be installed in the walls of a metal building instead of or in addition to on the roof.

In a preferred embodiment, the roof apparatus 10 also includes thermal break panels 152, 154 installed beneath one or more of the caps 114, 116, as shown in FIGS. 13-16 and 45-50. The thermal break panels 152, 154 may provide an insulating air gap separating the interface from interior building temperatures. In some embodiments, the thermal breaks 152, 154 are made of plastic in order to prevent tearing or catching on the insulation 13. In an alternate embodiment, the thermal breaks 252, 254 are made of aluminum, and further comprise a gasket 253 to prevent the tearing and catching of the insulation 13.

In a preferred embodiment, the roof apparatus 10 also includes one or more vent systems 40, 210, 340. The vent system 40, 210, 340 may be installed in the roof panels or wall panels of the building. The vent system 40, 210, 340 preferably includes two vent rails 41 341, the vent rails 41, 341 to be placed parallel to one another on either side of, for example, an exhaust pipe 48, 248. The pipe 48, 248 and rails 41, 341 are preferably covered with a cap 42, 242. Preferably, the roof rails 41, 341 have grooves 46 for mating with an existing metal roof system similar to the grooves 38 of the side rails 12A, 12B in prior embodiments, a vertical wall 43 that runs parallel to the pipe 48, 248, a flange 45, 245 at the top of the vertical wall 43, and vent holes 44, 244 that are at the top of the vertical wall 43 just before the flange 45, 245. Preferably, the cap 42, 242 is configured to attach to the flanges 45, 245 of the vent rails 41. See for example FIGS. 51-55.

Preferably, when the vent systems 40 are placed on the roof of the building, they are placed along the line of the slope of the roof from ridge 6 to eave 7 on the front and back of the building.

The present invention includes an apparatus 10 for modifying an existing metal building to include an additional device or feature. The feature may be installed on the roof or side walls of the building. The device or feature of be installed may include a skylight, lighting panel, electronic equipment, HVAC or other air filtration system, or ventilation systems. The metal building is preferably comprised of a series of metal panels. Most often, R-panels are used; however, the present invention may be adapted for use with any metal panel. The apparatus 10 comprises a plurality of mounting brackets 18, at least two caps 14, 16, at least two side rails 12A, 12B, at least two end panels 28, 32, and a plurality of screws 55.

Preferably the apparatus of the present invention is a "screw through" system meaning that the apparatus is attached to the metal building using screws that go all the way through the building. This means that water flow and deflection are important for preventing leaks in the building.

The existing building to be modified has a support structure 4 and the area of the building to be modified has a high point and a low point. For roof installations, the high point is the ridge 6, and the low point is the eave 7. For wall installations, the high point is the roof line, and the low point is the ground or foundation. The mounting brackets 18 are placed on support structure of the existing building. In a roof installation the mounting brackets are placed on the purlins 22 as shown in FIGS. 2-24. The end panel 32 to be placed at the low point or eave 7 preferably has interface legs or grooves 34 for mating with the existing panels 8 and end panels. The starter panel 28 for the high point or ridge 6 preferably includes a cricket for directing water flow into the valleys 39 of the side rails 12A, 12B. End caps 14 are preferable placed at both ends of the installation and middle caps 16 are placed in between at a pre-determined distance from each other. The distance is determined by what is being installed. For example, for a skylight installation as shown in FIGS. 2-24, the distance between the caps is the length needed for the skylight 20. The side rails 12A, 12B are placed parallel to each other, the interface 38 of the rail mating with the ridge of the existing panels. The rails 12A, 12B create a curb with the caps 14, 16 for supporting the installation, e.g. skylight 20.

The "curb" created with the present invention may also be used to support a light fixture, an HVAC unit, or other equipment.

The side rails 12A, 12B have a horizontal section or valley 39 that is generally perpendicular to a generally vertical wall 37. Preferably, the vertical wall 37 has a top flange 35 and a raised section in the middle of the rail 12A, 12B that supports the device to be installed. The rails 12A, 12B have shorter sections on the ends that also have a flange 29. Preferably, the horizontal section of the side rail 12A, 12B has at least one interface leg or ridge 38 that is capable of matching the ridges of the panels 8 of the existing metal building.

The present invention may also be installed on buildings that have insulation 13 under the metal panels. Preferably, when installed on an insulated building, the apparatus 10 further comprises at least two thermal break panels 152, 154, which are placed under the caps 14, 16.

Preferably, the apparatus 10 further comprises clips or fasteners 31, 33 for connecting the side rails 12A, 12B to the mounting brackets 18 and existing metal panels 8. The clips or fasteners 33 may placed over the side rail leaving them exposed. Alternatively, the clips or fasteners 31 may be placed under the side rail leaving them hidden. The present invention includes a variety of interface legs 38 of the side rails 12A, 12B, examples of which are shown in FIGS. 25-29. Preferably, the interface legs 38 are placed over the existing metal building panels, to best prevent water build-up form leaking into the building. However, the legs may also be placed under the existing metal building panels.

Figure 51:
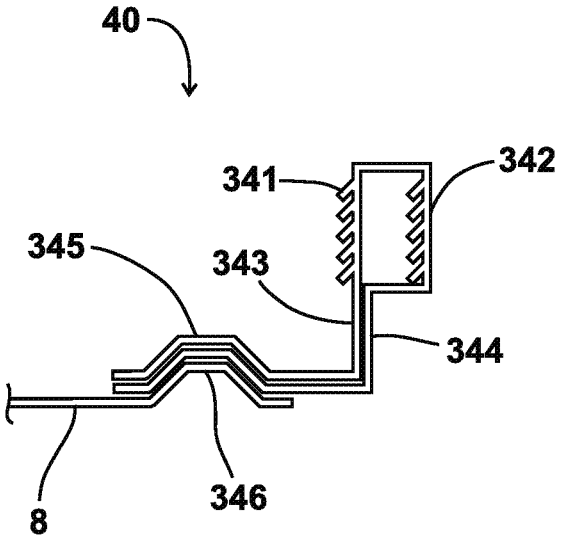
FIGS. 51-52 and 54 are profile views of different embodiments of the vent system of the present invention.
Figure 52:
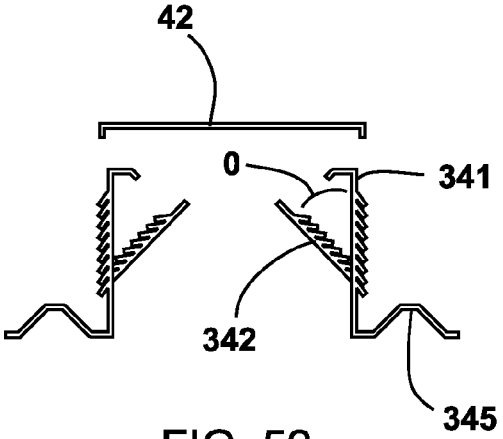
Figure 53:
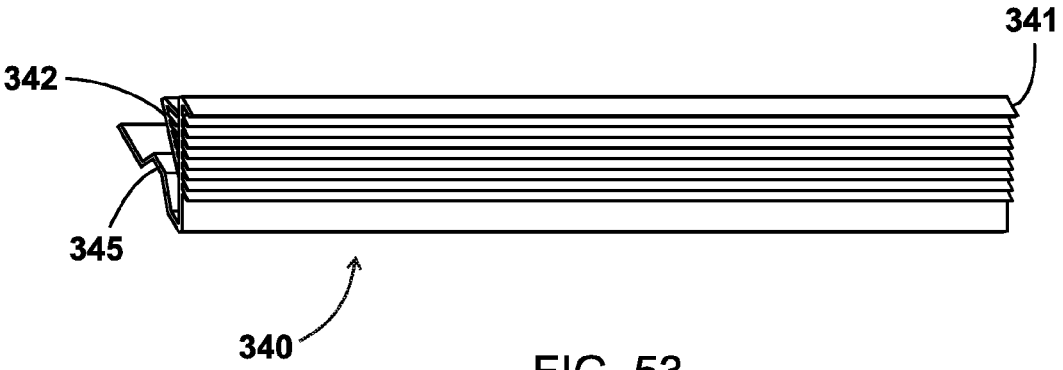
FIGS. 53 and 55 are perspective views of different embodiments of the vent rail of the present invention.
Figure 54:
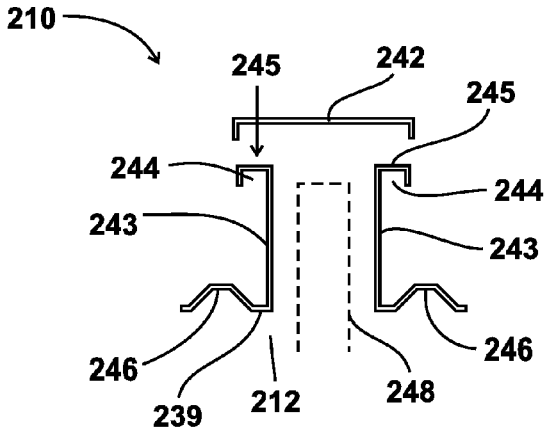
Figure 55:
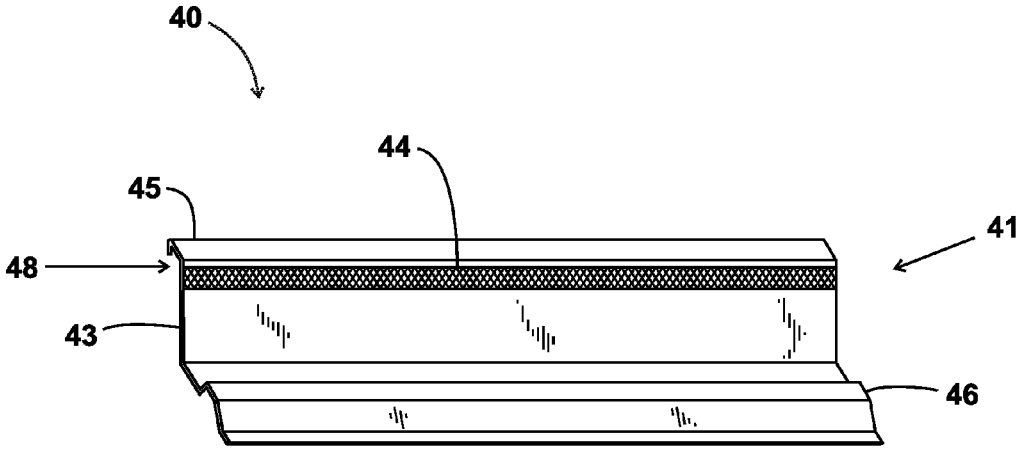

In some embodiments, the side rails 41 further include ventilation holes 44 in the vertical wall 43. This ventilation system may also include a secondary vent wall 342 as shown in FIGS. 51-55. The angle θ between the vertical vent wall and secondary wall is preferably between 10 and 90 degrees as shown in FIG. 52. However, in some embodiments the secondary wall is parallel to the vertical wall as shown in FIG. 51.

Figure 32:
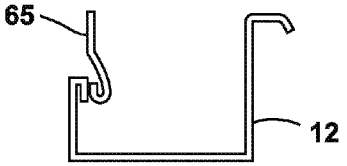
FIG. 32 is a profile view of an alternate embodiment of a side rail and whip connector of the present invention prior to the whip being crimped to the side rail.
Figure 33:
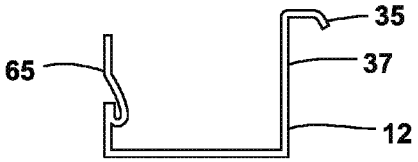
FIG. 33 is a profile view of an alternate embodiment of a side rail and whip connector of the present invention after the whip has been crimped to the side rail.

The apparatus 10 of present invention may be adapted for use on a variety of metal buildings. In some embodiments, the side rails 12 have a horizontal section that is generally perpendicular to a generally vertical wall, the horizontal section having a flange opposite the vertical wall, and the vertical wall having a flange opposite the horizontal section, the vertical wall having shorter sections on the ends and a raised section in the middle. The apparatus further comprises at least two adapters or whips 65 for connecting the side rails 12 to the existing metal building panels 8 as shown in FIGS. 32-33. The whips 65 have a flange for crimping with the flange on the horizontal section of the side rail 12. FIG. 32 shows the connection before crimping and FIG. 33 shows the connection after crimping.

A preferred embodiment includes a conduit 410 on the side rail 412 and a corresponding conduit 415 on the mounting bracket 418. When installed the conduits 410, 415 mate to form a conduit channel running generally parallel to the horizontal section and extending the entire length of the side rail 412. The conduit may be used for housing wiring or tubing as needed.

In an alternate embodiment, the starter panel 28 is replaced with a ridge side rail as shown in FIGS. 56-57. The ridge side rail 312 mates with the existing panels and the side rails 12A, 12B and allows the device installed closer to the ridge 6 of the roof In this embodiment, the end cap is replaced with a ridge cap 310.

Figure 39:
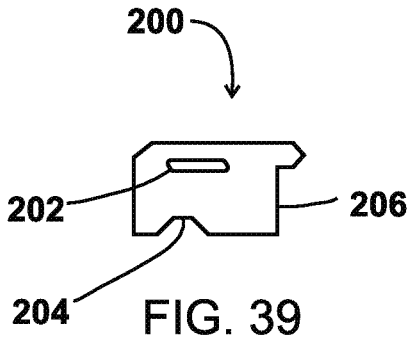
FIGS. 39-40 are views of a preferred embodiment of the block head of the present invention.
Figure 40:
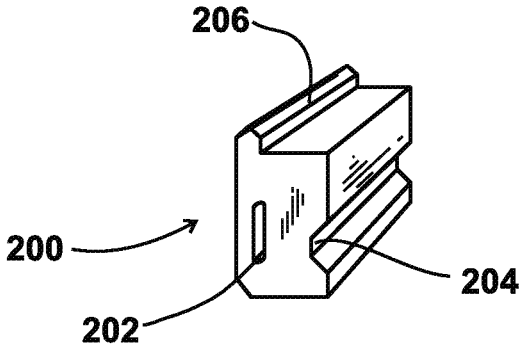
Figure 41:
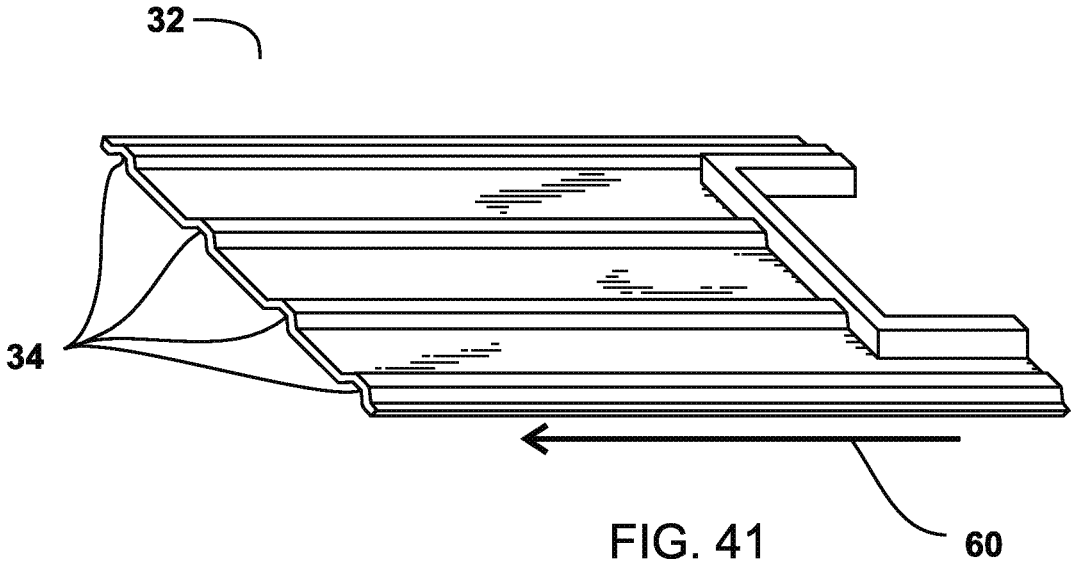
FIG. 41 is a perspective view of a preferred embodiment of the eave panel of the present invention.

The present invention also includes a tool, called a block head 200 for aiding in the installation of the apparatus of the present invention. The block head 200 as shown in FIGS. 39-40, preferably has a handle, an interface leg, and a mounting bracket guide. The tool 200 is sized so that when the interface leg of the tool is placed on the ridge of the existing R-panel, the mounting bracket guide of the tool is located where the mounting bracket should be installed.

The Block Head 200 is a tool to help install the in-line curb system. There is an Interface Leg notch at the bottom of the Block Head 200 that, when positioned over the side lap of an adjacent R-panel 8, provides proper alignment for the mounting bracket 18 on the roof support system 22. Lines on the Block Head 200 give quick positioning indications for the placement of the Eave Panel 32 on the roof support system. Preferably, there is a knob on the end of the Block Head 200 that can be used to push the bottom side of the side lap of an R-panel 8 up to engage the stitch screws 55 of the in-line curb system 10.

The present invention also includes a method of installing the apparatus 10. Preferably, the method comprises the steps of:

(a) removing the existing panels 8 from the metal building in the area to be modified (FIG. 3);

(b) cutting the middle section of insulation 13 and removing it, leaving a portion of exposed insulation 13 on either side of the remaining panels 8 (FIGS. 4-5);

(c) rolling the remaining exposed insulation 13 back over the remaining panels 8 exposing the support structure 21, 22, 23 for the building (FIGS. 6-7);

(d) placing mounting brackets 18 over each of the exposed support structures 21, 22, 23 (FIGS. 8-9);

(e) folding the exposed insulation 13 back over the mounting brackets 18 (FIG. 10;

(f) placing an end panel at the end of the exposed area that is at the low point of the building (FIG. 11);

(g) placing one or more side rails 12A on one side of the exposed area such that the interface leg 38 of the side rail(s) 12A matches with the ridge of the existing panel 8 and rolling the remaining insulation 13 on the side where the side rail 12A is placed so that it is covered by the side rail 12A (FIG. 12);

(h) placing thermal break panels 152, 154 at each of the shorter sections of the side rail 12A (FIGS. 13-14);

(i) placing one or more side rail 12Bs on the opposite side of the exposed area and rolling the insulation 13 on that side so that it is covered by the side rail 12B (FIG. 15);

(j) placing a second end panel 28 at the end of the exposed area that is at the high point of the building (FIG. 16);

(k) placing caps 14, 16 over the thermal break panels 152, 154 (FIG. 17);

(l) placing the device or feature in the area now framed by the caps 14, 16 and side rails 12A, 12B (FIGS. 18-19); and (m) using the screws 55 to secure the apparatus to the building.

When the apparatus 10 of the present invention is installed on a roof, the support structure is preferably purlins 21, 22, 23.

The panels could be any type of metal building materials. Preferably, R-panels are used.

The method of the present invention may be used for installing skylights 20 as shown. Alternatively the\apparatus and method of the present invention can be used to install or incorporate lighting, sensors, wiring and controls in any number of configurations into the system.

Lights—the lights could be LED, OLED, Florescent or any other type of light source. It is expected that the light fixtures would be added to the thermal breaks 152, 154 to light the interior of the building, but these items could also be added to any other of the in-line curb system's components.

Sensors—sensors measuring any internal or external parameters could be added to any of the in-line curb systems' components. Fire monitors, poisonous gas sensors, and light meters are some examples of the types of sensors that could be installed into the in-line curb system.

Wiring—wiring harnesses can be added to the in-line curb system to provide power and or control signals to the lights and sensors. Heated wiring harnesses and other types of wiring systems could be installed into the curb system.

Controls—wired and wireless controls can be added to the curb system. The controllers can monitor and control the lights and sensors installed into the curb system.

To provide easy roof-top access to the internal components, watertight hatches and closures could be added to the caps 14, 16 of the in-line curb system 10.

Additionally, the side rails 412 and mounting brackets 418 can include conduits 410, 415 to allow for wiring to be safely included in the structure. See FIG. 58.

Large Roof-top Equipment—To allow large roof-top equipment such as large HVAC units to be installed on metal roofs while spreading out the dead load of such equipment, a third and/or forth side rail 12 can be installed in the in-line curb system 10. The top-flange 35 of the additional rails 12 can be oriented in different directions to support the units while facilitating the use of different middle/end cap 14, 16 designs.

An alternate method wherein the building is not an R-panel building comprises the following steps:

(a) removing the existing panels from the metal building in the area to be modified exposing the support structures of the building;

(b) placing mounting brackets 18 over each of the exposed support structures;

(c) placing an end panel at the end of the exposed area that is at the low point of the building;

(d) placing one or more side rails 12A, 12B on one side of the exposed area such that the flange of the horizontal section of the side rail is adjacent to the existing panel;

(e) placing a whip 65 over the side rail flange and the existing panel (see FIG. 32);

(f) crimping the whip 65 to the side rail 12 so it secures the side rail to the existing panel (see FIG. 33);

(g) placing one or more side rails on the opposite side of the exposed area such that the flange of the horizontal section of the side rail is adjacent to the existing panel;

(h) placing a whip 65 over the side rail flange and the existing panel; (i) crimping the adapter so it secures the side rail to the existing panel;

(j) placing a second end panel at the end of the exposed area that is at the high point of the building;

(k) placing caps at each of the shorter sections of the side rails;

(l) placing the device or feature in the area now framed by the caps and side rails; and (m) using the screws 55 to secure the apparatus to the building.

| PARTS LIST: | |
|---|---|
| 1 | top of end cap 14 |
| 2 | bay |
| 3 | side of end cap 14 |
| 4 | main roof support |
| 5 | rail of end cap 14 |
| 6 | ridge |
| 7 | eave |
| 8 | building panel |
| 9 | coupler of end cap 14 |
| 9A | highs of building panel 8 |
| 10 | curb system |
| 11 | lows of building panel 8 |
| 12 | side rail |
| 12A | first side rail |
| 12B | second side rail |
| 13 | insulation |
| 14 | end cap |
| 15 | middle portion of middle cap 16 |
| 16 | middle cap |
| 17 | side of middle cap 16 |
| 18 | mounting brackets |
| 19 | rails of middle cap 16 |
| 20 | skylights |
| 21 | eave purlin |
| 22 | purlin |
| 23 | ridge purlin |
| 24 | raised portion of side rail for accepting skylight |
| 26 | coupler of eave panel 32 |
| 27 | coupler of starter panel 28 |
| 28 | ridge/starter panel |
| 29 | bottom flange of side rail 12 |
| 30 | cricket |
| 31 | exposed clip/fastener |
| 32 | eave panel |
| 33 | hidden clip/fastener |
| 34 | interface legs of eave panel 32 for mating with interface legs of side rail/roof panel |
| 35 | top flange of side rail |
| 36 | interface legs of starter panel 28 for mating with interface legs of side rail/roof panel |
| 37 | vertical wall of side rail 12 |
| 38 | interface legs of side rail 12 |
| 39 | valley of side rail 12 |
| 40 | vent system |
| 41 | vent rail |
| 42 | cap for vent system |
| 43 | vertical wall of vent rail |
| 44 | vent holes |
| 45 | top flange of vent rail |
| 46 | grooves of vent rail (panel interface) |
| 48 | pipe |
| 50 | ridge cap |
| 55 | screws |
| 60 | arrow showing water flow |

-continued

| PARTS LIST: | |
|---|---|
| 65 | whip—preferably 24-gauge metal |
| 68 | middle of mounting bracket |
| 69 | sides of mounting bracket |
| 152 | thermal break end |
| 154 | thermal break middle |
| 160 | bridge (not shown) |
| 200 | block head |
| 202 | handle of block head |
| 204 | interface leg of block head |
| 206 | mounting bracket guide of block head |
| 210 | alternate embodiment of the system of the present invention with venting system |
| 212 | side rail |
| 239 | valley |
| 242 | cap for roof vent |
| 243 | vertical wall of side rail with vents |
| 244 | vent holes in side rail |
| 245 | top flange of side rail with vents |
| 246 | interface legs of side rail |
| 248 | exhaust pipe |
| 252 | thermal break end with gasket |
| 253 | gasket |
| 254 | thermal break middle with gasket |
| 300 | alternate ridge set-up |
| 310 | alternate ridge cap |
| 312 | alternate side rail for ridge |
| 340 | alternate vent system |
| 341 | vent rail |
| 342 | secondary vent rail |
| 343 | vertical wall of vent rail |
| 344 | vertical wall of secondary vent rail |
| 345 | interface legs of vent rail |
| 346 | interface of secondary vent rail |
| 410 | alternate side rail conduit |
| 412 | alternate side rail with wiring conduit |
| 415 | alternate mounting bracket conduit |
| 418 | alternate mounting bracket with wiring conduit |
| 429 | bottom flange of alternate side rail |
| 435 | top flange of alternate side rail |
| 437 | vertical wall of alternate side rail |
| 438 | interface (grooves of alternate side rail) |
| 439 | valley of alternate side rail |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An apparatus for modifying an existing metal building to include an additional device or feature, the existing metal building having a support structure, a high point and a low point and comprising metal panels, and the apparatus replacing one or more of the panels of the metal building, each said panel having edges, the apparatus comprising:

a) a plurality of mounting brackets, at least two caps, first and second side rails, at least two end panels, and a plurality of screws;

b) wherein the mounting brackets are placed on the support structure of the existing building;

c) wherein one of the at least two end panels is placed at the low point of the metal building;

d) wherein the first side rail is placed on an edge of an existing building panel;

e) wherein two caps are placed a determined distance from each other;

f) wherein the second rail is placed parallel to the first side rail;

g) wherein another of the at least two end panels is placed at the high point of the existing metal building, and the additional device or feature is placed on the side rails and caps; and h) wherein the mounting brackets, side rails, end panels, and existing metal building panels are connected using the screws.

2. The apparatus of claim 1 wherein the existing building has insulation under the metal panels, and the apparatus further comprises at least two thermal break panels, the thermal break panels placed under the caps.

3. A method of installing the apparatus of claim 2 comprising the steps of:

(a) removing the existing panels from the metal building in an area to be modified;

(b) cutting a section of insulation and removing it, leaving a portion of exposed insulation on either side of the remaining panels;

(c) rolling the remaining exposed insulation back over the remaining panels, exposing the support structure for the building to provide an exposed area;

(d) placing multiple of said mounting brackets over the exposed support structures of step "c";

(e) folding the exposed insulation back over the mounting brackets;

(f) placing an end panel at the low point of the building;

(g) placing a side rail on one side of the exposed area such that the interface of the side rail(s) matches with a ridge of the existing panel;

(h) rolling the remaining insulation on the side where the side rail is placed so that it is covered by the side rail;

(i) placing thermal break panels at each of the shorter sections of the side rails;

(j) placing one or more side rails on the opposite side of the exposed area and rolling the insulation on that side so that it is covered by the side rail;

(k) placing a second end panel at the end of the exposed area that is at the high point of the building;

(l) placing the device or feature in the area now framed by the side rails; and (m) using the screws to secure the apparatus to the building.

4. The method of claim 3 wherein the side rails installed have a conduit on the vertical wall, the conduit running generally parallel to the horizontal section and extending an entire length of the side rail; and wherein the mounting brackets have a horizontal section and two vertical walls, the vertical walls having a corresponding conduit for matching with the conduit on the side rails, the method further comprising a step of placing wiring or other necessary tubing or piping in the conduit before completing the installation.

5. The method of claim 3, performed during installation of an original roof or a reinstallation.

6. The apparatus of claim 1 wherein the side rails have a horizontal section that is generally perpendicular to a generally vertical wall, the horizontal section having a flange opposite the vertical wall, and the vertical wall having a flange opposite the horizontal section, the vertical wall having ends with shorter sections and a raised section in between the ends; wherein, the apparatus further comprises at least two adapters for connecting the side rails to the existing metal building panels.

7. A kit for attaching a device to a metal roof, the roof having a roof framework including multiple roof supports, purlins that span between said supports, and roof panels covering the purlins and roof supports, wherein the roof has an uppermost ridge portion and a lower eave portion, and the roof panels have grooves, the kit comprising:

an interface that is to be supported by the roof framework and when so supported supports the device at a position spaced above the framework, said interface comprising:

two side rails, each side rail having grooves for mating with the grooves of said roof panel, a plurality of mounting brackets configured to attach to the side rails;

a ridge panel having grooves for mating with the grooves of the side rails and a first coupler on the ridge panel;

an eave panel having grooves for mating with the grooves of the side rails and a second coupler;

a first end cap that is configured to mate with the two side rails, and the second coupler; and a second end cap that is configured to mate with the two said side rails, and the first coupler.

8. The kit of claim 7, further comprising:

a cricket to deflect water towards the grooves of the side rails.

9. The kit of claim 8 for attaching multiple devices to the roof, further comprising:

middle caps for placement between the devices.

10. The kit of claim 8, wherein the cricket is integral with the ridge panel.

11. The kit of claim 7 for attaching at least a second device to the roof, further comprising:

a middle cap for placement between a first device and the second device.

12. The kit of claim 7, wherein the first end cap is configured to mate with an under surface of said device, and wherein the second end cap is configured to mate with an under surface of said device.

13. The kit of claim 7, further comprising the device to be mounted to said roof framework.

14. A method of attaching a device to a metal roof, the roof having a roof framework including multiple roof supports, purlins that span between said supports, and roof panels covering the purlins and roof supports, wherein the roof has an uppermost ridge portion and a lower eave portion, and the roof panels have grooves, the method comprising:

providing an interface that is to be supported by the roof framework and when so supported supports the device at a position spaced above the framework, said interface comprising:

two side rails, each side rail having grooves for mating with the grooves of said roof panel, a first end cap and a second end cap;

a plurality of mounting brackets configured to attach to the side rails;

a ridge panel having grooves for mating with the grooves of the side rails and a first coupler on the ridge panel configured to receive an end cap, an eave panel having grooves for mating with the grooves of the side rails and a second coupler configured to receive an end cap; and wherein the first end cap is configured to mate with said device, the two side rails, and the second coupler; and wherein the second end cap is configured to mate with said device, the two said side rails, and the first coupler;

attaching the eave panel to said roof panels wherein its grooves mate with the grooves of two adjoining but spaced apart roof panels;

attaching the side rails to the brackets after mating the grooves of the side rails with the grooves of the two adjoining but spaced apart roof panels and with the grooves of the eave panel;

attaching the ridge panel such that its grooves mate with the grooves of two adjoining but spaced apart roof panels and with the grooves of the side rails;

attaching the first end cap to the first coupler and the side rails;

attaching the second end cap to the second coupler and the side rails;

attaching the device to the first and second end caps and to the side rails.

15. The method of claim 14, further comprising removing an existing roof panel from the metal building to expose the roof supports.

16. The method of claim 14, wherein screws are used to secure the interface to the building.

17. The method of claim 14, wherein the device is a skylight.

18. The method of claim 17, performed during installation of an original roof or a reinstallation.

19. The method of claim 14, wherein the device is a skylight and is attached over the end caps and side rails.

* * * * *